US008760442B2

(12) United States Patent
Yamazaki et al.

(10) Patent No.: US 8,760,442 B2
(45) Date of Patent: Jun. 24, 2014

(54) DISPLAY DEVICE AND E-BOOK READER PROVIDED THEREWITH

(75) Inventors: Shunpei Yamazaki, Setagaya (JP); Jun Koyama, Sagamihara (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 548 days.

(21) Appl. No.: 13/029,147

(22) Filed: Feb. 17, 2011

(65) Prior Publication Data

US 2011/0210949 A1 Sep. 1, 2011

(30) Foreign Application Priority Data

Feb. 26, 2010 (JP) ..... 2010-041987

(51) Int. Cl.
*G09G 5/00* (2006.01)

(52) U.S. Cl.
USPC ..... 345/204; 345/87; 345/107

(58) Field of Classification Search
USPC ..... 345/38, 50–54, 60, 64, 87–107, 204; 349/69
See application file for complete search history.

(56) References Cited

U.S. PATENT DOCUMENTS

| | | | | |
|---|---|---|---|---|
| 5,731,856 | A | 3/1998 | Kim et al. | |
| 5,744,864 | A | 4/1998 | Cillessen et al. | |
| 6,294,274 | B1 | 9/2001 | Kawazoe et al. | |
| 6,335,728 | B1 * | 1/2002 | Kida et al. | 345/204 |
| 6,563,174 | B2 | 5/2003 | Kawasaki et al. | |
| 6,727,522 | B1 | 4/2004 | Kawasaki et al. | |
| 7,027,074 | B2 | 4/2006 | Koyama | |
| 7,049,190 | B2 | 5/2006 | Takeda et al. | |

(Continued)

FOREIGN PATENT DOCUMENTS

| | | |
|---|---|---|
| CN | 1317779 | 10/2001 |
| EP | 1146502 A | 10/2001 |

(Continued)

OTHER PUBLICATIONS

Fortunato.E et al., "Wide-Bandgap High-Mobility ZnO Thin-Film Transistors Produced At Room Temperature,", Appl. Phys. Lett. (Applied Physics Letters) , Sep. 27, 2004, vol. 85, No. 13, pp. 2541-2543.

(Continued)

*Primary Examiner* — Amare Mengistu
*Assistant Examiner* — Vinh Lam
(74) *Attorney, Agent, or Firm* — Eric J. Robinson; Robinson Intellectual Property Law Office, P.C.

(57) ABSTRACT

An object is to provide a display device in which deterioration in display quality due to a change in voltage applied is reduced and a lower visible efficiency in changing display is prevented. The display device has a display controller configured to make the display portion perform display by switching a first still image display period including a writing period in which a first image signal is written and a holding period in which the first image signal is held, and a second still image display period including a writing period in which a second image signal is written and a holding period in which the second image signal is held. The display controller is configured to make a length of the writing period of the first still image display period and a length of the writing period of the second still image display period different from each other.

19 Claims, 11 Drawing Sheets

(56) References Cited

U.S. PATENT DOCUMENTS

| | | | | |
|---|---|---|---|---|
| 7,061,014 | B2 | 6/2006 | Hosono et al. | |
| 7,064,346 | B2 | 6/2006 | Kawasaki et al. | |
| 7,105,868 | B2 | 9/2006 | Nause et al. | |
| 7,196,689 | B2 | 3/2007 | Moriyama | |
| 7,211,825 | B2 | 5/2007 | Shih et al. | |
| 7,282,782 | B2 | 10/2007 | Hoffman et al. | |
| 7,297,977 | B2 | 11/2007 | Hoffman et al. | |
| 7,298,365 | B2 | 11/2007 | Moriyama | |
| 7,323,356 | B2 | 1/2008 | Hosono et al. | |
| 7,324,123 | B2 | 1/2008 | Yamazaki et al. | |
| 7,330,169 | B2 | 2/2008 | Koyama | |
| 7,385,224 | B2 | 6/2008 | Ishii et al. | |
| 7,402,506 | B2 | 7/2008 | Levy et al. | |
| 7,411,209 | B2 | 8/2008 | Endo et al. | |
| 7,453,065 | B2 | 11/2008 | Saito et al. | |
| 7,453,087 | B2 | 11/2008 | Iwasaki | |
| 7,462,862 | B2 | 12/2008 | Hoffman et al. | |
| 7,468,304 | B2 | 12/2008 | Kaji et al. | |
| 7,501,293 | B2 | 3/2009 | Ito et al. | |
| 7,502,039 | B2 | 3/2009 | Koyama et al. | |
| 7,674,650 | B2 | 3/2010 | Akimoto et al. | |
| 7,732,819 | B2 | 6/2010 | Akimoto et al. | |
| 2001/0046027 | A1 | 11/2001 | Tai et al. | |
| 2001/0052887 | A1 | 12/2001 | Tsutsui et al. | |
| 2002/0015031 | A1* | 2/2002 | Fujita et al. | 345/204 |
| 2002/0056838 | A1 | 5/2002 | Ogawa | |
| 2002/0132454 | A1 | 9/2002 | Ohtsu et al. | |
| 2003/0080932 | A1* | 5/2003 | Konno et al. | 345/96 |
| 2003/0179221 | A1* | 9/2003 | Nitta et al. | 345/690 |
| 2003/0189401 | A1 | 10/2003 | Kido et al. | |
| 2003/0197673 | A1* | 10/2003 | Nakamura | 345/99 |
| 2003/0218222 | A1 | 11/2003 | Wager et al. | |
| 2004/0038446 | A1 | 2/2004 | Takeda et al. | |
| 2004/0127038 | A1 | 7/2004 | Carcia et al. | |
| 2005/0017302 | A1 | 1/2005 | Hoffman | |
| 2005/0199959 | A1 | 9/2005 | Chiang et al. | |
| 2006/0035452 | A1 | 2/2006 | Carcia et al. | |
| 2006/0043377 | A1 | 3/2006 | Hoffman et al. | |
| 2006/0091793 | A1 | 5/2006 | Baude et al. | |
| 2006/0108529 | A1 | 5/2006 | Saito et al. | |
| 2006/0108636 | A1 | 5/2006 | Sano et al. | |
| 2006/0110867 | A1 | 5/2006 | Yabuta et al. | |
| 2006/0113536 | A1 | 6/2006 | Kumomi et al. | |
| 2006/0113539 | A1 | 6/2006 | Sano et al. | |
| 2006/0113549 | A1 | 6/2006 | Den et al. | |
| 2006/0113565 | A1 | 6/2006 | Abe et al. | |
| 2006/0169973 | A1 | 8/2006 | Isa et al. | |
| 2006/0170111 | A1 | 8/2006 | Isa et al. | |
| 2006/0176261 | A1* | 8/2006 | Nitta et al. | 345/94 |
| 2006/0197092 | A1 | 9/2006 | Hoffman et al. | |
| 2006/0208977 | A1 | 9/2006 | Kimura | |
| 2006/0228974 | A1 | 10/2006 | Thelss et al. | |
| 2006/0231882 | A1 | 10/2006 | Kim et al. | |
| 2006/0238135 | A1 | 10/2006 | Kimura | |
| 2006/0238458 | A1 | 10/2006 | Koyama | |
| 2006/0244107 | A1 | 11/2006 | Sugihara et al. | |
| 2006/0284171 | A1 | 12/2006 | Levy et al. | |
| 2006/0284172 | A1 | 12/2006 | Ishii | |
| 2006/0292777 | A1 | 12/2006 | Dunbar | |
| 2007/0024187 | A1 | 2/2007 | Shin et al. | |
| 2007/0046191 | A1 | 3/2007 | Saito | |
| 2007/0052025 | A1 | 3/2007 | Yabuta | |
| 2007/0054507 | A1 | 3/2007 | Kaji et al. | |
| 2007/0090365 | A1 | 4/2007 | Hayashi et al. | |
| 2007/0108446 | A1 | 5/2007 | Akimoto | |
| 2007/0152217 | A1 | 7/2007 | Lai et al. | |
| 2007/0172591 | A1 | 7/2007 | Seo et al. | |
| 2007/0187678 | A1 | 8/2007 | Hirao et al. | |
| 2007/0187760 | A1 | 8/2007 | Furuta et al. | |
| 2007/0194379 | A1 | 8/2007 | Hosono et al. | |
| 2007/0229447 | A1* | 10/2007 | Takahara et al. | 345/102 |
| 2007/0252928 | A1 | 11/2007 | Ito et al. | |
| 2007/0272922 | A1 | 11/2007 | Kim et al. | |
| 2007/0287296 | A1 | 12/2007 | Chang | |
| 2008/0006877 | A1 | 1/2008 | Mardilovich et al. | |
| 2008/0038882 | A1 | 2/2008 | Takechi et al. | |
| 2008/0038929 | A1 | 2/2008 | Chang | |
| 2008/0048180 | A1* | 2/2008 | Abe et al. | 257/40 |
| 2008/0050595 | A1 | 2/2008 | Nakagawara et al. | |
| 2008/0073653 | A1 | 3/2008 | Iwasaki | |
| 2008/0083950 | A1 | 4/2008 | Pan et al. | |
| 2008/0106191 | A1 | 5/2008 | Kawase | |
| 2008/0128689 | A1 | 6/2008 | Lee et al. | |
| 2008/0129195 | A1 | 6/2008 | Ishizaki et al. | |
| 2008/0166834 | A1 | 7/2008 | Kim et al. | |
| 2008/0182358 | A1 | 7/2008 | Cowdery-Corvan et al. | |
| 2008/0224133 | A1 | 9/2008 | Park et al. | |
| 2008/0238850 | A1* | 10/2008 | Watanabe | 345/90 |
| 2008/0254569 | A1 | 10/2008 | Hoffman et al. | |
| 2008/0258139 | A1 | 10/2008 | Ito et al. | |
| 2008/0258140 | A1 | 10/2008 | Lee et al. | |
| 2008/0258141 | A1 | 10/2008 | Park et al. | |
| 2008/0258143 | A1 | 10/2008 | Kim et al. | |
| 2008/0284700 | A1* | 11/2008 | Oke et al. | 345/89 |
| 2008/0296568 | A1 | 12/2008 | Ryu et al. | |
| 2009/0068773 | A1 | 3/2009 | Lai et al. | |
| 2009/0073325 | A1 | 3/2009 | Kuwabara et al. | |
| 2009/0073343 | A1* | 3/2009 | Kojima et al. | 349/61 |
| 2009/0114910 | A1 | 5/2009 | Chang | |
| 2009/0134399 | A1 | 5/2009 | Sakakura et al. | |
| 2009/0152506 | A1 | 6/2009 | Umeda et al. | |
| 2009/0152541 | A1 | 6/2009 | Maekawa et al. | |
| 2009/0278122 | A1 | 11/2009 | Hosono et al. | |
| 2009/0280600 | A1 | 11/2009 | Hosono et al. | |
| 2009/0309823 | A1* | 12/2009 | Kimura | 345/92 |
| 2010/0065844 | A1 | 3/2010 | Tokunaga | |
| 2010/0085375 | A1* | 4/2010 | Chung et al. | 345/589 |
| 2010/0092800 | A1 | 4/2010 | Itagaki et al. | |
| 2010/0109002 | A1 | 5/2010 | Itagaki et al. | |
| 2010/0156768 | A1* | 6/2010 | Fletcher et al. | 345/87 |
| 2011/0049511 | A1 | 3/2011 | Yano et al. | |
| 2011/0148826 | A1* | 6/2011 | Koyama et al. | 345/204 |

FOREIGN PATENT DOCUMENTS

| | | | |
|---|---|---|---|
| EP | 1737044 | A | 12/2006 |
| EP | 2226847 | A | 9/2010 |
| JP | 60-198861 | A | 10/1985 |
| JP | 63-210022 | A | 8/1988 |
| JP | 63-210023 | A | 8/1988 |
| JP | 63-210024 | A | 8/1988 |
| JP | 63-215519 | A | 9/1988 |
| JP | 63-239117 | A | 10/1988 |
| JP | 63-265818 | A | 11/1988 |
| JP | 05-251705 | A | 9/1993 |
| JP | 08-264794 | A | 10/1996 |
| JP | 11-505377 | | 5/1999 |
| JP | 2000-044236 | A | 2/2000 |
| JP | 2000-150900 | A | 5/2000 |
| JP | 2002-076356 | A | 3/2002 |
| JP | 2002-182619 | A | 6/2002 |
| JP | 2002-289859 | A | 10/2002 |
| JP | 2002-297105 | A | 10/2002 |
| JP | 2003-086000 | A | 3/2003 |
| JP | 2003-086808 | A | 3/2003 |
| JP | 2004-103957 | A | 4/2004 |
| JP | 2004-273614 | A | 9/2004 |
| JP | 2004-273732 | A | 9/2004 |
| JP | 2004-318123 | A | 11/2004 |
| JP | 2005-037962 | A | 2/2005 |
| JP | 2006-065018 | A | 3/2006 |
| JP | 2007-018095 | A | 1/2007 |
| JP | 2009-217415 | A | 9/2009 |
| JP | 2009-223169 | A | 10/2009 |
| KR | 2002-0005400 | A | 1/2002 |
| WO | WO-2004/114391 | | 12/2004 |
| WO | WO-2009/091013 | | 7/2009 |

OTHER PUBLICATIONS

Dembo.H et al., "RFCPUS on Glass and Plastic Substrates Fabricated by TFT Transfer Technology,", IEDM 05: Technical Digest of International Electron Devices Meeting, Dec. 5, 2005, pp. 1067-1069.

(56) References Cited

OTHER PUBLICATIONS

Ikeda.T et al., "Full-Functional System Liquid Crystal Display Using CG-Silicon Technology," SID Digest '04 : SID International Symposium Digest of Technical Papers, 2004, vol. 35, pp. 860-863.
Nomura.K et al., "Room-Temperature Fabrication of Transparent Flexible Thin-Film Transistors Using Amorphous Oxide Semiconductors,", Nature, Nov. 25, 2004, vol. 432, pp. 488-492.
Park.J et al., "Improvements in the Device Characteristics of Amorphous Indium Gallium Zinc Oxide Thin-Film Transistors by Ar Plasma Treatment,", Appl. Lett. (Applied Physics Letters) , Jun. 26, 2007, vol. 90, No. 26, pp. 262106-262106-3.
Takahashi.M et al., "Theoretical Analysis of IGZO Transparent Amorphous Oxide Semiconductor,", IDW '08 : Proceedings of the 15th International Display Workshops, Dec. 3, 2008, pp. 1637-1640.
Hayashi.R et al., "42.1: Invited Paper: Improved Amorphous In—Ga—Zn—O TFTS,", SID Digest '08 : SID International Symposium Digest of Technical Papers, May 20, 2008, vol. 39, pp. 621-624.
Prins.M et al., "A Ferroelectric Transparent Thin-Film Transistor,", Appl. Phys. Lett. (Applied Physics Letters) , Jun. 17, 1996, vol. 68, No. 25, pp. 3650-3652.
Nakamura.M et al., "The phase relations in the In2O3—Ga2ZnO4—ZnO system at 1350° C.,", Journal of Solid State Chemistry, Aug. 1, 1991, vol. 93, No. 2, pp. 298-315.
Kimizuka.N. et al., "Syntheses and Single-Crystal Data of Homologous Compounds, In2O3(ZnO)m (m = 3, 4, and 5), InGAO3(ZnO)3, and Ga2O3(ZnO)m (m = 7, 8, 9, and 16) in the In2O3—ZnGa2O4—ZnO Systems,", Journal of Solid State Chemistry, Apr. 1, 1995, vol. 116, No. 1, pp. 170-178.
Nomura.K et al., "Thin-Film Transistor Fabricated in Single-Crystalline Transparent Oxide Semiconductor,", Science, May 23, 2003, vol. 300, No. 5623, pp. 1269-1272.
Masuda.S et al., "Transparent thin film transistors using ZnO as an active channel layer and their electrical properties,", J. Appl. Phys. (Journal of Applied Physics) , Feb. 1, 2003, vol. 93, No. 3, pp. 1624-1630.
Asakuma.N et al., "Crystallization and Reduction of Sol-Gel-Derived Zinc Oxide Films by Irradiation with Ultraviolet Lamp,", Journal of Sol-Gel Science and Technology, 2003, vol. 26, pp. 181-184.
Osada.T et al., "15.2: Development of Driver-Integrated Panel using Amorphous In—Ga—Zn-Oxide TFT,", SID Digest '09 : SID International Symposium Digest of Technical Papers, May 31, 2009, pp. 184-187.
Nomura.K et al., "Carrier transport in transparent oxide semiconductor with intrinsic structural randomness probed using single-crystalline InGaO3(ZnO)5 films,", Appl. Phys. Lett. (Applied Physics Letters) , Sep. 13, 2004, vol. 85, No. 11, pp. 1993-1995.
Li.C et al., "Modulated Structures of Homologous Compounds InMO3(ZnO)m (M=In,Ga; m=Integer) Described by Four-Dimensional Superspace Group,", Journal of Solid State Chemistry, 1998, vol. 139, pp. 347-355.
Son.K et al., "42.4L: Late-News Paper: 4 Inch QVGA AMOLED Driven by the Threshold Voltage Controlled Amorphous GIZO (Ga2O3—In2O3—ZnO) TFT,", SID Digest '08 : SID International Symposium Digest of Technical Papers, May 20, 2008, vol. 39, pp. 633-636.
Lee.J et al., "World's Largest (15-Inch) XGA AMLCD Panel Using IGZO Oxide TFT,", SID Digest '08 : SID International Symposium Digest of Technical Papers, May 20, 2008, vol. 39, pp. 625-628.
Nowatari.H et al., "60.2: Intermediate Connector With Suppressed Voltage Loss for White Tandem OLEDS,", SID Digest '09 : SID International Symposium Digest of Technical Papers, May 31, 2009, vol. 40, pp. 899-902.
Kanno.H et al., "White Stacked Electrophosphorecent Organic Light-Emitting Devices Employing MOO3 as a Charge-Generation Layer,", Adv. Mater. (Advanced Materials), 2006, vol. 18, No. 3, pp. 339-342.
Tsuda.K et al., "Ultra Low Power Consumption Technologies for Mobile TFT-LCDs ,", IDW '02 : Proceedings of the 9th International Display Workshops, Dec. 4, 2002, pp. 295-298.
Van de Walle.C, "Hydrogen as a Cause of Doping in Zinc Oxide,", Phys. Rev. Lett. (Physical Review Letters), Jul. 31, 2000, vol. 85, No. 5, pp. 1012-1015.
Fung.T et al., "2-D Numerical Simulation of High Performance Amorphous In—Ga—Zn—O TFTs for Flat Panel Displays,", AM—FPD '08 Digest of Technical Papers, Jul. 2, 2008, pp. 251-252, The Japan Society of Applied Physics.
Jeong.J et al., "3.1: Distinguished Paper: 12.1-Inch WXGA AMOLED Display Driven by Indium-Gallium-Zinc Oxide TFTs Array,", SID Digest '08 : SID International Symposium Digest of Technical Papers, May 20, 2008, vol. 39, No. 1, pp. 1-4.
Park.J et al., "High performance amorphous oxide thin film transistors with self-aligned top-gate structure,", IEDM 09: Technical Digest of International Electron Devices Meeting, Dec. 7, 2009, pp. 191-194.
Kurokawa.Y et al., "UHF RFCPUS on Flexible and Glass Substrates for Secure RFID Systems,", Journal of Solid-State Circuits , 2008, vol. 43, No. 1, pp. 292-299.
Ohara.H et al., "Amorphous In—Ga—Zn-Oxide TFTs with Suppressed Variation for 4.0 inch QVGA AMOLED Display,", AM—FPD '09 Digest of Technical Papers, Jul. 1, 2009, pp. 227-230, The Japan Society of Applied Physics.
Coates.D et al., "Optical Studies of the Amorphous Liquid-Cholesteric Liquid Crystal Transistion: The "Blue Phase",", Physics Letters, Sep. 10, 1973, vol. 45A, No. 2, pp. 115-116.
Cho.D et al., "21.2:AL and SN-Doped Zinc Indium Oxide Thin Film Transistors for AMOLED Back Plane,", SID Digest '09 : SID International Symposium Digest of Technical Papers, May 31, 2009, pp. 280-283.
Lee.M et al., "15.4:Excellent Performance of Indium-Oxide-Based Thin-Film Transistors by DC Sputtering,", SID Digest '09 : SID International Symposium Digest of Technical Papers, May 31, 2009, pp. 191-193.
Jin.D et al., "65.2:Distinguished Paper:World-Largest (6.5") Flexible Full Color Top Emission AMOLED Display on Plastic Film and its Bending Properties,", SID Digest '09 : SID International Symposium Digest of Technical Papers, May 31, 2009, pp. 983-985.
Sakata.J et al., "Development of 4.0-IN. AMOLED Display With Driver Circuit Using Amorphous In—Ga—Zn-Oxide TFTS,", IDW '09 : Proceedings of the 16th International Display Workshops, 2009, pp. 689-692.
Park.J et al., "Amorphous Indium-Gallium-Zinc Oxide TFTS and Their Application for Large Size AMOLED,", AM—FPD '08 Digest of Technical Papers, Jul. 2, 2008, pp. 275-278.
Park.S et al., "Challenge to Future Displays: Transparent AM-OLED Driven by Peald Grown ZnO TFT,", IMID '07 Digest, 2007, pp. 1249-1252.
Godo.H et al., "Temperature Dependence of Characteristics and Electronic Structure for Amorphous In—Ga—Zn-Oxide TFT,", AM—FPD '09 Digest of Technical Papers, Jul. 1, 2009, pp. 41-44.
Osada.T et al., "Development of Driver-Integrated Panel Using Amorphous In—Ga—Zn-Oxide TFT,", Am—FPD '09 Digest of Technical Papers, Jul. 1, 2009, pp. 33-36.
Hirao.T et al., "Novel Top-Gate Zinc Oxide Thin-Film Transistors (ZnO TFTS) for AMLCDS,", Journal of the SID, 2007, vol. 15, No. 1, pp. 17-22.
Hosono.H, "68.3:Invited Paper:Transparent Amorphous Oxide Semiconductors for High Performance TFT,", SID Digest '07 : SID International Symposium Digest of Technical Papers, 2007, vol. 38, pp. 1830-1833.
Godo.H et al., "P-9:Numerical Analysis on Temperature Dependence of Characteristics of Amorphous In—Ga—Zn-Oxide TFT,", SID Digest '09 : SID International Symposium Digest of Technical Papers, May 31, 2009, pp. 1110-1112.
Ohara.H et al., "21.3:4.0 In. QVGA AMOLED Display Using In—Ga—Zn-Oxide TFTS With a Novel Passivation Layer,", SID Digest '09 : SID International Symposium Digest of Technical Papers, May 31, 2009, pp. 284-287.
Miyasaka.M, "SUFTLA Flexible Microelectronics on Their Way to Business,", SID Digest '07 : SID International Symposium Digest of Technical Papers, 2007, vol. 38, pp. 1673-1676.

(56) References Cited

OTHER PUBLICATIONS

Chern.H et al., "An Analytical Model for the Above-Threshold Characteristics of Polysilicon Thin-Film Transistors,", IEEE Transactions on Electron Devices, Jul. 1, 1995, vol. 42, No. 7, pp. 1240-1246.
Kikuchi.H et al., "39.1:Invited Paper:Optically Isotropic NANO-Structured Liquid Crystal Composites for Display Applications,", SID Digest '09 : SID International Symposium Digest of Technical Papers, May 31, 2009, pp. 578-581.
Asaoka.Y et al., "29.1:Polarizer-Free Reflective LCD Combined With Ultra Low-Power Driving Technology,", SID Digest '09 : SID International Symposium Digest of Technical Papers, May 31, 2009, pp. 395-398.
Lee.H et al., "Current Status of, Challenges to, and Perspective View of AM-OLED ,", IDW '06 : Proceedings of the 13th International Display Workshops, Dec. 7, 2006, pp. 663-666.
Kikuchi.H et al., "62.2:Invited Paper:Fast Electro-Optical Switching in Polymer-Stabilized Liquid Crystalline Blue Phases for Display Application,", SID Digest '07 : SID International Symposium Digest of Technical Papers, 2007, vol. 38, pp. 1737-1740.
Nakamura.M, "Synthesis of Homologous Compound with New Long-Period Structure,", NIRIM Newsletter, Mar. 1, 1995, vol. 150, pp. 1-4.
Kikuchi.H et al., "Polymer-Stabilized Liquid Crystal Blue Phases,", Nature Materials, Sep. 2, 2002, vol. 1, pp. 64-68.
Kimizuka.N et al., "Spinel,YBFE2O4, and YB2FE3O7 Types of Structures for Compounds in the In2O3 and SC2O3 and SC2O3—A2O3—Bo Systems [A; Fe, Ga, Or Al; B: Mg, Mn, Fe, Ni, Cu,Or Zn] at Temperatures over 1000° C.,", Journal of Solid State Chemistry, 1985, vol. 60, pp. 382-384.
Kitzerow.H et al., "Observation of Blue Phases in Chiral Networks,", Liquid Crystals, 1993, vol. 14, No. 3, pp. 911-916.
Costello.M et al., "Electron Microscopy of a Cholesteric Liquid Crystal and Its Blue Phase,", Phys. Rev. A (Physical Review. A), May 1, 1984, vol. 29, No. 5, pp. 2957-2959.
Meiboom.S et al., "Theory of the Blue Phase of Cholesteric Liquid Crystals,", Phys. Rev. Lett. (Physical Review Letters), May 4, 1981, vol. 46, No. 18, pp. 1216-1219.
Park.Sang-Hee et al., "42.3: Transparent ZnO Thin Film Transistor for the Application of High Aperture Ratio Bottom Emission AM-OLED Display,", SID Digest '08 : SID International Symposium Digest of Technical Papers, May 20, 2008, vol. 39, pp. 629-632.
Orita.M et al., "Mechanism of Electrical Conductivity of Transparent InGaZnO4,", Phys. Rev. B (Physical Review. B), Jan. 15, 2000, vol. 61, No. 3, pp. 1811-1816.
Nomura.K et al., "Amorphous Oxide Semiconductors for High-Performance Flexible Thin-Film Transistors,", Jpn. J. Appl. Phys. (Japanese Journal of Applied Physics) , 2006, vol. 45, No. 5B, pp. 4303-4308.
Janotti.A et al., "Native Point Defects in ZnO,", Phys. Rev. B (Physical Review. B), Oct. 4, 2007, vol. 76, No. 16, pp. 165202-1-165202-22.
Park.J et al., "Electronic Transport Properties of Amorphous Indium-Gallium-Zinc Oxide Semiconductor Upon Exposure to Water,", Appl. Phys. Lett. (Applied Physics Letters) , 2008, vol. 92, pp. 072104-1-072104-3.
Hsieh.H et al., "P-29:Modeling of Amorphous Oxide Semiconductor Thin Film Transistors and Subgap Density of States,", SID Digest '08 : SID International Symposium Digest of Technical Papers, 2008, vol. 39, pp. 1277-1280.
Janotti.A et al., "Oxygen Vacancies in ZnO,", Appl. Phys. Lett. (Applied Physics Letters) , 2005, vol. 87, pp. 122102-1-122102-3.
Oba.F et al., "Defect energetics in ZnO: A hybrid Hartree-Fock density functional study,", Phys. Rev. B (Physical Review. B), 2008, vol. 77, pp. 245202-1-245202-6.
Orita.M et al., "Amorphous transparent conductive oxide InGa03(ZnO)m (m<4):a Zn4s conductor,", Philosophical Magazine, 2001, vol. 81, No. 5, pp. 501-515.
Hosono.H et al., "Working hypothesis to explore novel wide band gap electrically conducting amorphous oxides and examples,", J. Non-Cryst. Solids (Journal of Noncrystalline Solids), 1996, vol. 198-200, pp. 165-169.
Mo.Y et al., "Amorphous Oxide TFT Backplanes for Large Size AMOLED Displays,", IDW '08 : Proceedings of the 6th International Display Workshops, Dec. 3, 2008, pp. 581-584.
Kim.S et al., "High-Performance oxide thin film transistors passivated by various gas plasmas,", 214th ECS Meeting, 2008, No. 2317, ECS.
Clark.S et al., "First Principles Methods Using Castep,", Zeitschrift fur Kristallographie, 2005, vol. 220, pp. 567-570.
Lany.S et al., "Dopability, Intrinsic Conductivity, and Nonstoichiometry of Transparent Conducting Oxides,", Phys. Rev. Lett. (Physical Review Letters), Jan. 26, 2007, vol. 98, pp. 045501-1-045501-4.
Park.J et al., "Dry etching of ZnO films and plasma-induced damage to optical properties,", J. Vac. Sci. Technol. B (Journal of Vacuum Science & Technology B), Mar. 1, 2003, vol. 21, No. 2, pp. 800-803.
Oh.M et al., "Improving the Gate Stability of ZnO Thin-Film Transistors With Aluminum Oxide Dielectric Layers,", J. Electrochem. Soc. (Journal of the Electrochemical Society), 2008, vol. 155, No. 12, pp. H1009-H1014.
Ueno.K et al., "Field-Effect Transistor on SrTiO3 With Sputtered Al2O3 Gate Insulator,", Appl. Phys. Lett. (Applied Physics Letters) , Sep. 1, 2003, vol. 83, No. 9, pp. 1755-1757.
Kawamura.T et al., "1.5-V Operating Fully-Depleted Amorphous Oxide Thin Film Transistors Achieved by 63-mV/dec Subthreshold Slope,", IEDM 08: Technical Digest of International Electron Devices Meeting, Dec. 15, 2008.
International Search Report (Application no. PCT/JPJP2011/052801) Dated May 24, 2011.
Written Opinion (Application No. PCT/JPJP2011/052801) Dated May 24, 2011.

* cited by examiner

DISPLAY DEVICE AND E-BOOK READER PROVIDED THEREWITH

TECHNICAL FIELD

The present invention relates to a driving method of a display device. Further, the present invention relates to a display device. Furthermore, the present invention relates to an e-book reader provided with a display device.

BACKGROUND ART

In recent years, as a digitization technology has been developed, image data and text data of a newspaper, a magazine, and the like can be provided as electronic data. The contents of such a kind of electronic data are generally read by being displayed on a display device included in a television, a personal computer, a portable electronic terminal, or the like.

Display media such as a liquid crystal display device are very different form paper media such as a newspaper and a magazine. One of features of display media is that pages are switched on a screen of a display device, which is very different from the way paper media usually are handled. Such a difference in the way they are handled causes the display media a problem such as a lower visible efficiency in text reading, sentence comprehension, or image recognition than the paper media.

It is important for display media such as a liquid crystal display device to increase in visible efficiency and to reduce in power consumption in order to be conveniently used. As a countermeasure, a technique is disclosed in which power consumption is decreased by reduction in refresh rate, that is, the number of times of rewriting an image data (see Patent Document 1).

[Reference]

[Patent Document 1] Japanese Published Patent Application No. 2002-182619

DISCLOSURE OF INVENTION

According to Patent Document 1, power consumption can be reduced by lowering the refresh rate in displaying a still image. However, in a structure in Patent Document 1, because a transistor used for a pixel is formed using amorphous silicon, it is possible that voltage applied to a liquid crystal element which is a display element is decreased due to the off-state current of the transistor. In addition, in Patent Document 1, because time needed for rewriting an image is short, an image is momentarily updated to a newly written image when different images are switched by supplying different image signals between a period and the next period to perform display; which is different from a paper medium.

An object of an embodiment of the present invention is to provide a display device in which deterioration in display quality due to a change in voltage applied to a display element is reduced and a lower visible efficiency in changing display is prevented An embodiment of the present invention is a display device which has a display controller configured to make the display portion perform display by switching a first still image display period comprising a writing period in which a first image signal is written and a holding period in which the first image signal is held and a second still image display period comprising a writing period in which a second image signal is written and a holding period in which the second image signal is held. Further, the display controller is configured to make a length of the writing period of the first still image display period and a length of the writing period of the second still image display period different from each other.

An embodiment of the present invention is a display device which has a display controller configured to make the display device perform display by switching a first still image display period comprising a writing period in which a first image signal is written and a holding period in which the first image signal is held and a second still image display period comprising a writing period in which a second image signal is written and a holding period in which the second image signal is held. Further, the display controller is configured to make a length of the writing period of the first still image display period and a length of the writing period of the second still image display period different from each other. The display controller includes a switching circuit which is configured to switch a first clock signal and a second clock signal and output the first clock signal or the second clock signal, and a display mode control circuit. The display mode control circuit is configured to make the length of the writing period of the first still image display period and the length of the writing period of the second still image display period different from each other by controlling the switching circuit.

An embodiment of the present invention is a display device which has a display controller for making the display device perform display by switching a first still image display period comprising a writing period in which a first image signal is written and a holding period in which the first image signal is held and a second still image display period comprising a writing period in which a second image signal is written and a holding period in which the second image signal is held. Further, the display controller makes a length of the writing period of the first still image display period and a length of the writing period of the second still image display period different from each other. The display controller includes a reference clock generation circuit which is configured to output a first clock signal, a dividing circuit which is configured to divide the first clock signal and output a second clock signal, a switching circuit which is configured to switch the first clock signal and the second clock signal and output the first clock signal or the second clock signal, and a display mode control circuit. The display mode control circuit is configured to make the length of the writing period of the first still image display period and the length of the writing period of the second still image display period different from each other by controlling the switching circuit.

An embodiment of the present invention may be a display device in which the first image signal of the first still image display period is the same as the first image signal written in the last first still image display period, and in which the second image signal of the second still image display period is different from the first image signal written in the last first still image display period or the second image signal written in the second still image display period.

An embodiment of the present invention may be a display device in which the writing period of the first still image display period is 16.6 milliseconds or less and the writing period of the second still image display period is 1 second or more.

An embodiment of the present invention can provide a display device in which deterioration in display quality due to a change in voltage applied to a display element is reduced and a lower visible efficiency in changing display is prevented.

BRIEF DESCRIPTION OF DRAWINGS

FIGS. 8A1 and 8A2 are plan views and FIG. 8B is a cross sectional view for illustrating a display device which is an embodiment of the present invention.

BEST MODE FOR CARRYING OUT THE INVENTION

Figure 1A:
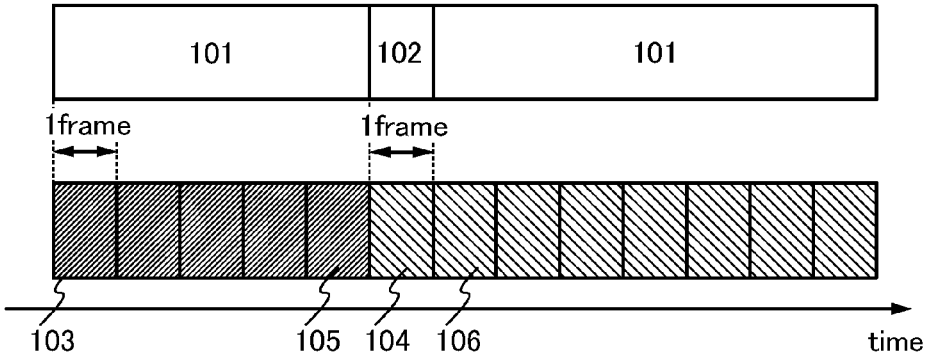
FIGS. 1A to 1C are schematic views for illustrating operation of a display device which is an embodiment of the present invention.

Hereinafter, embodiments of the present invention will be described with reference to the accompanying drawings. However, the present invention can be carried out in many different modes, and it is easily understood by those skilled in the art that modes and details of the present invention can be modified in various ways without departing from the purpose and the scope of the present invention. Therefore, this invention is not interpreted as being limited to the description of the embodiments below. Note that in structures of the present invention described below, identical portions are denoted by the same reference numerals in different drawings.

Note that the size, the thickness of a layer, the waveform of a signal, and a region of each structure illustrated in the drawings and the like in the embodiments are exaggerated for simplicity in some cases. Therefore, embodiments of the present invention are not limited to such scales.

Note that in this specification, terms such as "first", "second", "third", and "N-th" (N is a natural number) are used in order to avoid confusion among components and do not limit the number of the components.

(Embodiment 1)

In this embodiment, operation of a display device will be described with reference to a schematic view, a timing chart, a block diagram, a flowchart, or the like.

Figure 1B:
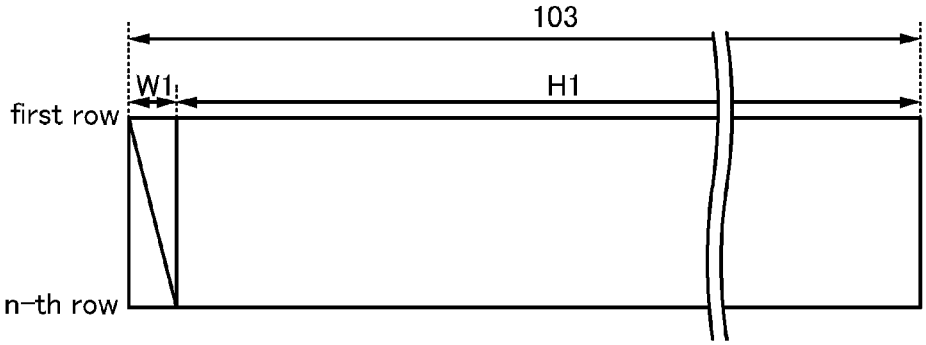
Figure 1C:
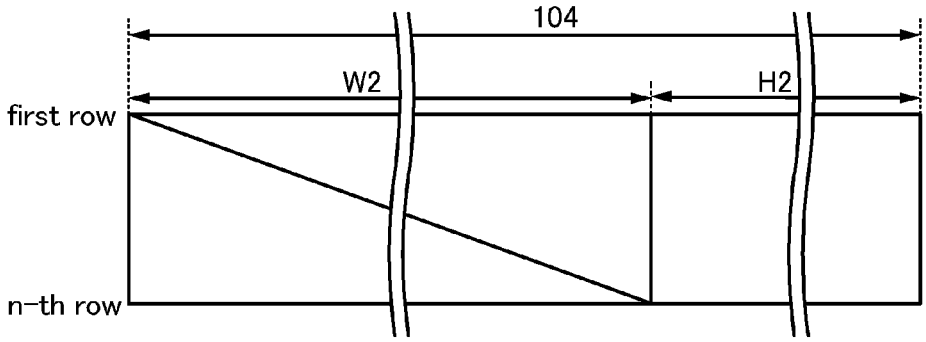

First, FIGS. 1A to 1C illustrate schematic views of a driving method of the display device. In this embodiment, a liquid crystal display device is described as an example of the display device.

Operation of the liquid crystal display device in this embodiment is roughly divided into an operation in a first still image display period 101 (also referred to as a first period) and an operation in a second still image display period 102 (also referred to as a second period) as illustrated in FIG. 1A.

The first still image display period 101 is a period during which one still image is displayed for sequential frame periods in which one image is displayed. An image signal (hereinafter, a first image signal) is written at a uniform refresh rate in the first still image display period 101. Accordingly, in one frame period in any one of the first still image display periods 101, periods 103 in which the first image signal that is the same image signal as the image signal in the last frame period is written are provided sequentially. Here, one frame period means a period during which an image displayed by sequential writing of image signals to a plurality of pixels in a display panel is renewed.

The second still image display period 102 is a period during which one frame period or sequential one frame periods in which an image is different from an image displayed by an image signal of the last frame period is/are provided, and one still image is displayed. In the second still image display period 102, when an image signal written in the last frame period is the first image signal, a different signal (a second image signal) is written. Accordingly, in a period 104 in which the second image signal is written and which is one frame period in the second still image display period 102, a second image signal is written which is a signal different from the signal of the last frame period of a period 105. Note that a period 106 in FIG. 1A is the same as the period 103 in that the same image signal as that in the last frame period (in this case, the period 104) is written. Note that in the case where frame periods for displaying different images are provided sequentially, the periods 104 in the second still image display period are sequentially provided, so that the second image signal is written which is different from the second image signal written in the last frame period.

Next, the period 103 in the first still image display period 101 is described with reference to FIG. 1B. The period 103 corresponding to one frame period of the first still image display period 101 includes a writing period and a holding period. Note that in FIG. 1B, the period 103 includes a writing period W1 (denoted by W1 in FIG. 1B) in which the first image signal is written to a pixel and a holding period H1 (denoted by H1 in FIG. 1B) in which the first image signal written to the pixel is held. In the writing period W1, the first image signal is sequentially written to the first to n-th rows of pixels in a display panel. In the writing period W 1, in order that the same image as the most previously written image is displayed, it is preferable that the first image signal be written within a short time so that a viewer does not feel a lower visible efficiency in changing display. Specifically, in the writing period W1 in which the first image signal is written in the first still image display period 101, writing is preferably performed at a speed of 16.6 milliseconds or less at which flickers do not occur. Further, it is preferable that as for the first image signal applied to a liquid crystal element be held by turning off a transistor in the holding period H1. That is to say, in the holding period H1, it is preferable that the first image signal be held by taking advantage of extremely small voltage drop due to the leakage current of the transistor. The holding period H1 in which the first image signal is held in the first still image display period 101 is preferably 1 second or more, because such a length of time does not cause reduction in image quality due to a decrease in voltage applied to the liquid crystal element caused by cumulative elapsed time, and such a length of time can make eyestrain less severe.

Next, the period 104 in the second still image display period 102 is described with reference to FIG. 1C. The period 104 corresponding to one frame period of the second still image display period 102 includes a writing period and a holding period. Note that in FIG. 1C, the period 104 includes a writing period W2 (denoted by W2 in FIG. 1C) in which the second image signal is written to a pixel and a holding period H2 (denoted by H2 in FIG. 1C) in which the second image signal written to the pixel is held. In the writing period W2, the second image signal is sequentially written to the second to n-th rows of pixels in a display panel. In the writing period W2, in order that a different image from the most previously written image is displayed, unlike in the writing period W1, a viewer is allowed to perceive changing of display so that a viewer does not feel a lower visible efficiency in changing display like in the case where a viewer looks at a paper medium. Thus, the writing period W2 in which the second image signal is written to a pixel is preferably longer than the writing period W1 so that a viewer can perceive changing of display. Specifically, the writing period W2 in which the second image signal is written in the second still image display period 102 is preferably 1 second or more that is the writing speed at which a viewer can perceive the switching. Further, it is preferable that as for the written second image signal, voltage applied to a liquid crystal element be held by turning off the transistor in the holding period H2. That is to say, in the holding period H2, it is preferable that the second image signal be held by taking advantage of extremely small voltage drop due to the leakage current of the transistor. The holding period H2 in which the second image signal is held in the second still image display period 102 is preferably 1 second or more, because such a length of time does not cause reduction in image quality due to a decrease in voltage applied to the liquid crystal element caused by cumulative elapsed time, and such a length of time can make eyestrain less severe.

Figure 2A:
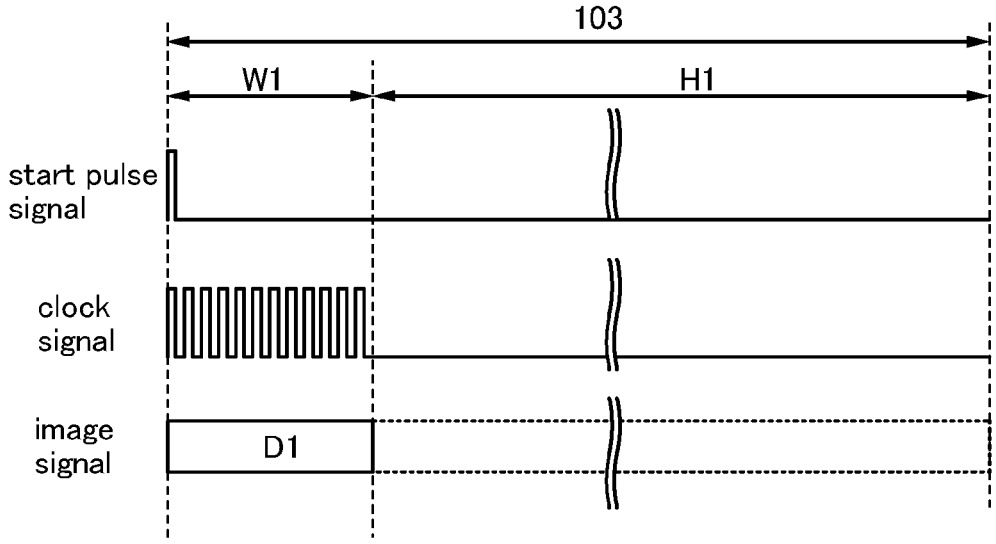
FIGS. 2A and 2B are timing charts for illustrating operation of the display device which is an embodiment of the present invention.
Figure 2B:
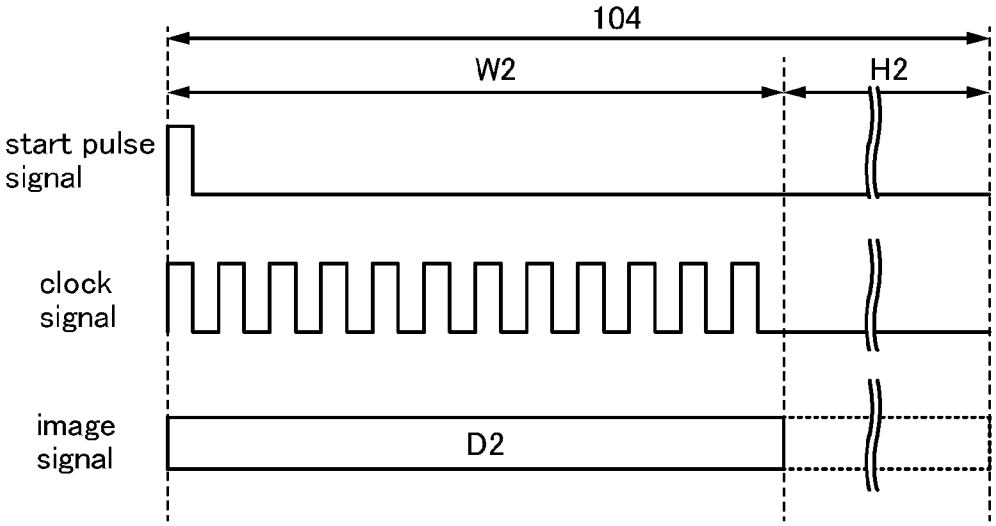

Next, a signal supplied to a driver circuit in the first still image display period 101 and the second still image display period 102 will be described with reference to FIGS. 2A and 2B illustrating timing charts of a start pulse signal and a clock signal in each period. Note that a waveform of each signal in timing charts illustrated in FIGS. 2A and 2B is exaggerated for description.

As illustrated in FIG. 2A, in the writing period W1 in which the first image signal is written of the period 103 of the first still image display period 101, a start pulse signal and a clock signal for driving a driver circuit such as a shift register circuit, which supplies the first image signal to each pixel in the display panel are supplied. The frequency or the like of the start pulse signal and the clock signal may be set as appropriate in accordance with the length of the writing period and the number of scanned pixels in the display panel. Note that with a structure in which voltage applied to a liquid crystal element is held by turning off the transistor, the start pulse signal and the clock signal can be stopped in the holding period H1 in which the first image signal is held of the period 103 of the first still image display period 101. Therefore, power consumption during the holding period H1 can be reduced. Note that supply of the first image signal D1 may be stopped as well as the start pulse signal and the clock signal so that in the holding period H1, an image is displayed only by holding voltage written in the writing period W1.

As illustrated in FIG. 2B, in the writing period W2 in which the second image signal is written of the period 104 of the second still image display period 102, a start pulse signal and a clock signal for driving a driver circuit such as a shift register circuit, which supplies the second image signal to each pixel in the display panel are supplied. The frequency or the like of the start pulse and the clock signal may be set as appropriate in accordance with the length of the writing period and the number of scanned pixels in the display panel. Note that with a structure in which voltage applied to a liquid crystal element is held by turning off the transistor, the start pulse signal and the clock signal can be stopped in the holding period H2 in which the second image signal is held of the period 104 of the second still image display period 102. Therefore, power consumption during the holding period H2 can be reduced. Note that supply of the second image signal D2 may be stopped as well as the start pulse signal and the clock signal so that in the holding period H2, an image is displayed only by holding voltage written in the writing period W2.

Note that as a clock signal supplied to the driver circuit in the second still image display period 102, a signal generated by dividing the clock signal supplied to the driver circuit in the first still image display period 101 may be used. With the structure, clock signals with a plurality of frequencies can be generated without a plurality of clock generation circuits for generating a clock signal, or the like. Note that in this structure, the frequency of the clock signal supplied to the driver circuit in the first still image display period 101 which is higher than that in the second still image display period 102 may be applied.

As described above, the structure is applied in which in the writing period W2 of the period 104 of the second still image display period 102, the pixels are scanned from the first row to the n-th row for 1 second or more and the second image signal is supplied, so that a viewer can perceive switching of images. The function corresponding to perception of switching pages in a paper medium is applied, so that a lower visible efficiency in changing display is prevented.

Switching between the first still image display period 101 and the second still image display period 102, which is illustrated in FIGS. 1A to 1C and FIGS. 2A and 2B, may be performed by a switching signal input from the outside by operation or the like or may be performed by judging in accordance with an image signal whether the first still image display period 101 or the second still image display period 102 is needed. Note that a moving image display period may be included in addition to the first still image display period 101 and the second still image display period 102.

Figure 3A:
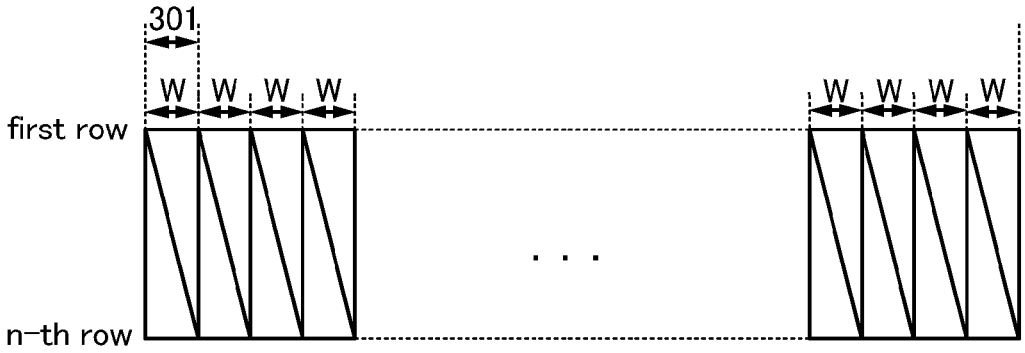
FIG. 3A is a schematic view and FIG. 3B is a timing chart for illustrating operation of the display device which is an embodiment of the present invention.
Figure 3B:
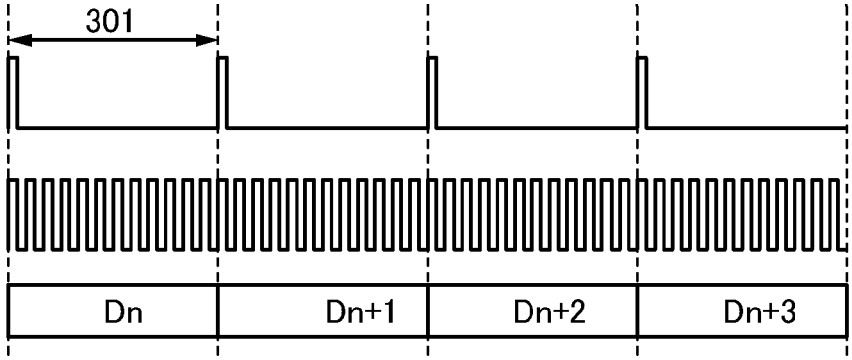

The moving image display period is described. A period 301 illustrated in FIG. 3A is regarded as one frame period of the moving image display period. The period 301 corresponding to one frame period of the moving image display period includes a writing period W (denoted by "W" in FIG. 3A) in which an image signal is written to a pixel. Note that the moving image display period may include a holding period in addition to the writing period W and the holding period is preferably short so that flickers do not occur. In the writing period W, image signals are sequentially written to pixels in a display panel from the first row to the n-th row. In the writing period W, different image signals are input to pixels in sequential frame periods and a viewer perceives a moving image. Specifically, in the writing period W in which the image signal is written in the moving image display period, writing is preferably performed at a speed of 16.6 milliseconds or less at which flickers do not occur. FIG. 3B shows a timing chart of a start pulse signal and a clock signal in each period so that a signal supplied to a driver circuit in the moving image display period 301 is described similarly to FIGS. 2A and 2B. As illustrated in FIG. 3B, in the writing period W corresponding to the period 301 of the moving image display period, a clock signal and a start pulse for driving a driver circuit such as a shift register circuit for supplying image signals (Dn, and Dn+1 to Dn+3) to pixels of the display panel are supplied. The frequency or the like of the start pulse and the clock signal may be set as appropriate in accordance with the length of the writing period and the number of scanned pixels in the display panel.

Figure 4:
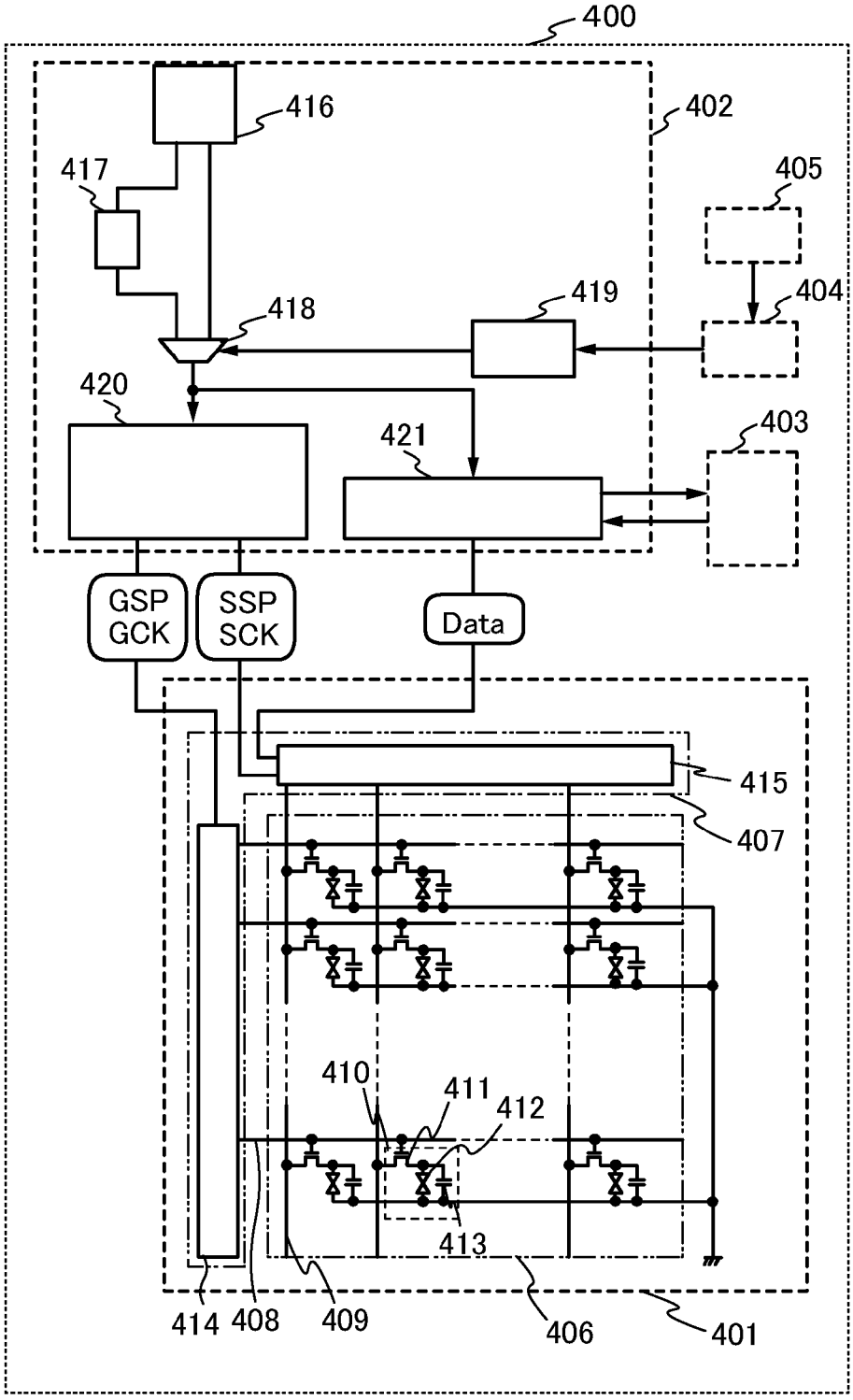
FIG. 4 is a block diagram for illustrating operation of the display device which is an embodiment of the present invention.

Next, the first still image display period 101 and the second still image display period 102 illustrated in FIGS. 1A to 1C and FIGS. 2A and 2B are described with reference to a block diagram of a liquid crystal display device for switching operation in FIG. 4. A liquid crystal display device 400 illustrated in FIG. 4 includes a display panel 401, a display controller 402, a memory circuit 403, a CPU 404 (also referred to as an arithmetic circuit), and an external input device 405.

The display panel 401 includes a display portion 406 and a driver circuit portion 407. The display portion 406 includes a plurality of gate lines 408 (also referred to as scan lines), a plurality of source lines 409 (also referred to as signal lines), and a plurality of pixels 410. Each of the plurality of pixels 410 includes a transistor 411, a liquid crystal element 412, and a capacitor 413. The driver circuit portion 407 includes a gate line driver circuit 414 (also referred to as a scan line driver circuit), and a source line driver circuit 415 (also referred to as a signal line driver circuit).

Note that in the transistor 411, an oxide semiconductor is preferably included in a semiconductor layer. When the number of carriers in an oxide semiconductor is made to be extremely small, the off-state current can be reduced. Accordingly, an electric signal such as an image signal can be held for a longer period in the pixel, and a writing interval can be set longer. The structure of the transistor may be an inverted-staggered structure or a staggered structure. Alternatively, a double-gate structure may be used in which a channel region is divided into a plurality of regions and the divided channel regions are connected in series. Alternatively, a dual-gate structure may be used in which gate electrodes are provided over and under the channel region. Further, the transistor element may be used in which a semiconductor layer is divided into a plurality of island-shaped semiconductor layers and which realizes switching operation.

Note that the liquid crystal element 412 is formed so that a liquid crystal is sandwiched between a first electrode and a second electrode. The first electrode of the liquid crystal element 412 corresponds to a pixel electrode. The second electrode of the liquid crystal element 412 corresponds to a counter electrode. The first electrodes and the second electrodes of the liquid crystal elements may each have a shape including a variety of opening patterns. As a liquid crystal material provided between the first electrodes and the second electrodes in the liquid crystal elements, thermotropic liquid crystal, low-molecular liquid crystal, high-molecular liquid crystal, polymer dispersed liquid crystal, ferroelectric liquid crystal, anti-ferroelectric liquid crystal, or the like may be used. Such a liquid crystal material exhibits a cholesteric phase, a smectic phase, a cubic phase, a chiral nematic phase, an isotropic phase, or the like depending on conditions. Alternatively, liquid crystal exhibiting a blue phase for which an alignment film is unnecessary may be used. The first electrode of the liquid crystal element 412 is formed using a material with a light-transmitting property or a metal with high reflectivity. As examples of the light-transmitting material, indium tin oxide (ITO), zinc oxide (ZnO), indium zinc oxide (IZO), gallium-doped zinc oxide (GZO), and the like can be given. Aluminum, silver, or the like is used for a metal electrode with high reflectivity. Note that the first electrode, the second electrode, and the liquid crystal material are collectively referred to as a liquid crystal element in some cases.

Note that, for example, the capacitor 413 includes a pixel electrode and a capacitor line which is additionally provided through an insulating layer. In the case where the off-state current of the transistor 411 is sufficiently reduced, the capacitor which is intentionally provided can be omitted because a holding period of an electric signal such as an image signal can be longer.

Note that, a liquid crystal display device in which the pixel 410 includes a liquid crystal element as a display element is assumed and each element is described; however, the element is not limited to a liquid crystal element and various display elements can be used such as an EL element or an electrophoresis element.

To the gate line 408, a signal for controlling on/off of the transistor 411 is supplied from the gate line driver circuit 414. To the source line 409, an image signal supplied to the liquid crystal element 412 is supplied from the source line driver circuit 415. Note that in FIG. 4, it is preferable that the display portion 406 be provided over the same substrate as the gate line driver circuit 414 and the source line driver circuit 415, but it is not necessary. When the gate line driver circuit 414 and the source line driver circuit 415 are provided over the same substrate as the display portion 406, the size of the liquid crystal display device can be reduced because the number of the connection terminals for connection to the outside can be decreased.

The display controller 402 includes a reference clock generation circuit 416, a dividing circuit 417, a switching circuit 418, a display mode control circuit 419, a control signal generation circuit 420, and an image signal output circuit 421.

The reference clock generation circuit 416 is a circuit configured to oscillate a clock signal with a constant frequency. The reference clock generation circuit 416 may have a ring oscillator or a crystal oscillator, for example. The dividing circuit 417 is a circuit configured to change the frequency of an inputted clock signal. The dividing circuit 417 may include a counter circuit, for example. The switching circuit 418 is a circuit configured to switch a clock signal from the reference clock generation circuit 416 (hereinafter, a first clock signal) and a clock signal from the dividing circuit 417 (hereinafter, a second clock signal) and output the first clock signal or the second clock signal. The switching circuit 418 may control conduction or non-conduction with a transistor.

The display mode control circuit 419 is controlled by the CPU 404 and is a circuit configured to control a switching of a clock signal, which is output from the switching circuit 418. By the control of the switching circuit 418, the first clock signal and the second clock signal can be switched, and a mode of a first still image display period and a mode of a second still image display period illustrated in FIGS. 2A and 2B can be switched.

The control signal generation circuit 420 is a circuit which is configured to generate control signals (a start pulse GSP, a start pulse SSP, a clock signal GCK, and a clock signal SCK) for driving the gate line driver circuit 414 and the source line driver circuit 415, on the basis of the first clock signal or the second clock signal which is selected. The image signal output circuit 421 is a circuit which is configured to read an image signal (Data) from the memory circuit 403 and output the image signal (Data) to the source line driver circuit 415 on the basis of the first clock signal or the second clock signal which is selected. Note that the image signal may be appropriately inverted in accordance with dot inversion driving, source line inversion driving, gate line inversion driving, frame inversion driving, or the like so as to be output to the display panel 401. Note that power supply potentials (a high power supply potential Vdd, a power supply potential Vss, and a common potential Vcom) are supplied to the display panel 401 although not illustrated.

The memory circuit 403 is a circuit which is configured to store an image signal for display with the display panel 401. The memory circuit 403 may include a static memory (SRAM), a dynamic memory (DRAM), a ferroelectric memory (FeRAM), an EEPROM, a flash memory, or the like.

The CPU 404 controls the display mode control circuit 419 or the like in accordance with a signal from the external input device 405 or the like. The external input device 405 may be an input button, an input keyboard, or a touch panel.

Figure 5:
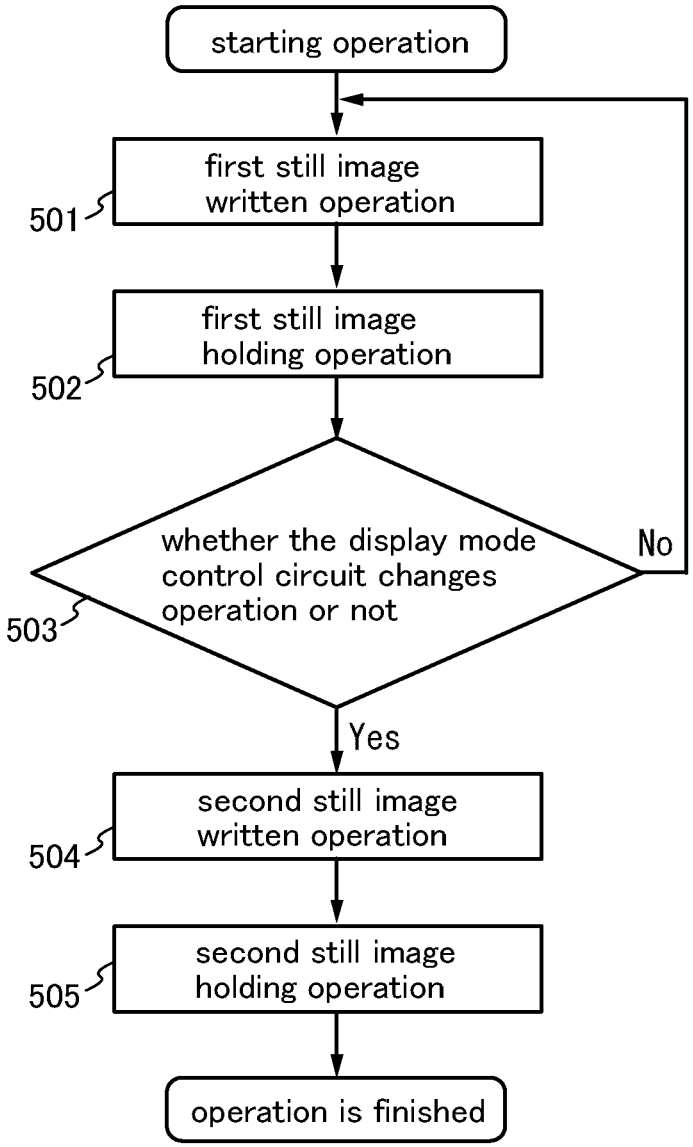
FIG. 5 is a flowchart for illustrating operation of the display device which is an embodiment of the present invention.

Next, specific operation between blocks in a block diagram in FIG. 4 will be described with reference to a flowchart of FIG. 5. Note that the flowchart of FIG. 5 illustrates a structure in which operation is performed by switching the first still image display period and the second still image display period which are described with reference to FIGS. 1A to 1C and FIGS. 2A and 2B. In the flowchart of FIG. 5, an operation example of switching from the first still image display period to the second still image display period is explained.

First, a step 501 in FIG. 5 is described. In the step 501, a first still image written operation in the first still image display period is performed. The step 501 corresponds to operation in the writing period W1 in which the first image signal is written in FIG. 2A. At this time, in FIG. 4, the display mode control circuit 419 selects the first clock signal output from the reference clock generation circuit 416 as a clock signal output from the switching circuit 418. With the use of the first clock signal, the first image signal is read from the memory circuit 403 by the image signal output circuit 421 and a control signal is generated in the control signal generation circuit 420. In the display panel 401, an image signal is written at speed at which a viewer does not perceive the writing.

Then, a step 502 in FIG. 5 is described. In the step 502, a first still image holding operation in the first still image display period is performed. The step 502 corresponds to operation in the holding period H1 in which the first image signal is held in FIG. 2A. At this time, in FIG. 4, the control signal from the control signal generation circuit 420 and the image signal from the image signal output circuit 421 are not output to the display panel 401. At this time, the first image signal applied to the liquid crystal element can be held by turning off a transistor, in which an oxide semiconductor is used for a semiconductor layer. Therefore, power consumption can be reduced by deactivating the control signal generation circuit 420 and the image signal output circuit 421. Note that when a holding period is made to be one second or more in the range in which image quality does not deteriorates due to dropping voltage applied to the liquid crystal element by cumulative elapsed time, such a length of time can make eyestrain less severe.

Then, a step 503 in FIG. 5 is described. In the step 503, whether the display mode control circuit 419 changes operation of the switching circuit 418 or not is judged. Specifically, depending on whether operation of changing pages of an e-book reader is performed by an operation button or the like in the external input device 405, whether the CPU 404 changes operation of the switching circuit 418 through the display mode control circuit 419 or not is determined In an example in the step 503, because without operation of the external input device 405, the CPU 404 does not control the display mode control circuit 419; thus, the first clock signal output from the switching circuit 418 is not changed. That is to say, a state of the step 501 is kept. On the other hand, in the case where operation of the external input device 405 is performed, that is, in the case where operation is performed by an operation button or the like in the external input device 405, the CPU 404 changes operation of the switching circuit 418 through the display mode control circuit 419. Specifically, a clock signal output from the switching circuit 418 is switched to the second clock signal output from the dividing circuit 417.

Next, a step 504 in FIG. 5 is described. In the step 504, a second still image written operation in the second still image display period is performed. The step 504 corresponds to operation in the writing period W2 of the second image signal in FIG. 2B. At this time, in FIG. 4, the display mode control circuit 419 selects the second clock signal output from the dividing circuit 417 as a clock signal to be output from the switching circuit 418. With the use of the second clock signal, the second image signal is read from the memory circuit 403 by the image signal output circuit 421 and a control signal or the like is generated in the control signal generation circuit 420. In the display panel 401, writing speed can be a speed at which a viewer can perceive switching of images. The function corresponds to perception of switching pages in a paper medium, and a lower visible efficiency in changing display is prevented.

Then, a step 505 in FIG. 5 is described. In the step 505, a second still image holding operation in the second still image display period is performed. The step 505 corresponds to operation in the holding period H2 in which the second image signal is held in FIG. 2B. At this time, in FIG. 4, the control signal from the control signal generation circuit 420 and the image signal from the image signal output circuit 421 are not output to the display panel 401. At this time, the second image signal applied to the liquid crystal element can be held by turning off a transistor, in which an oxide semiconductor is used for a semiconductor layer. Therefore, power consumption can be reduced by deactivating the control signal generation circuit 420 and the image signal output circuit 421. Note that when a holding period is made to be one second or more in the range in which image quality does not deteriorates due to dropping voltage applied to the liquid crystal element by cumulative elapsed time, such a length of time can make eyestrain less severe.

Note that in the case where the first image signal is written for display as in the step 501, the similar process to the step 501 and the step 502 may be performed. Further, in the case where the display mode control circuit 419 changes operation of the switching circuit 418 again as in the step 503, the similar process to the step 504 and the step 505 may be performed.

Next, an advantage obtained by the structure of this embodiment will be described with reference to schematic views of FIGS. 6A to 6C.

Figure 6A:
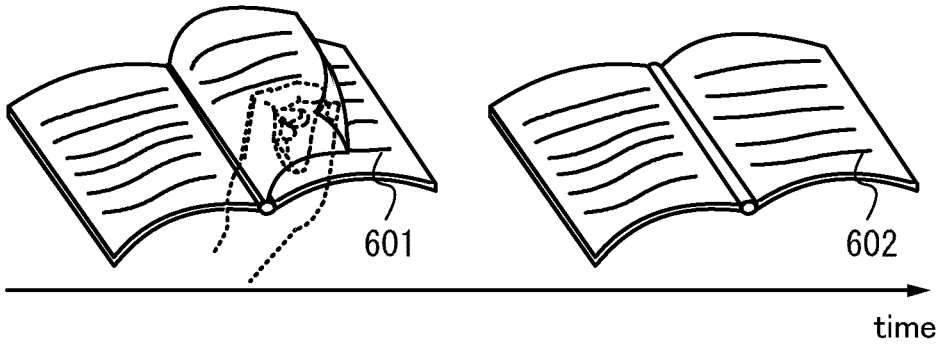
FIGS. 6A to 6C are schematic views for illustrating operation of the display device which is an embodiment of the present invention.

FIG. 6A illustrates a perspective view of a paper book and expresses the situation in which turning over a page over time is shown. It is apparent without FIG. 6A, but a viewer can see letters 602 in the next page of a paper book 601 through time needed for turning over a page.

Figure 6B:
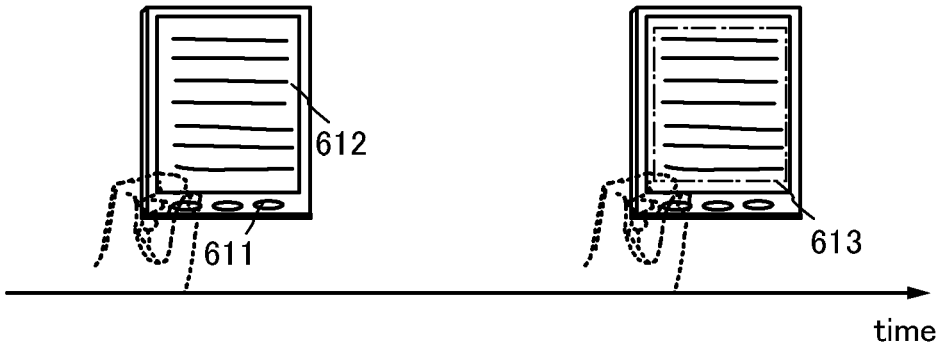

On the other hand, an e-book including a liquid crystal display device has an operation button 611 and a display panel 612 as illustrated in FIG. 6B, for example. It is possible that with a structure in FIG. 6B in which display is momentarily changed by pressing the operation button 611, unlike that in FIG. 6A, a viewer feels a lower visible efficiency in changing display. Further, when pages are unintentionally switched, it is possible that a viewer does not recognize the change.

Figure 6C:
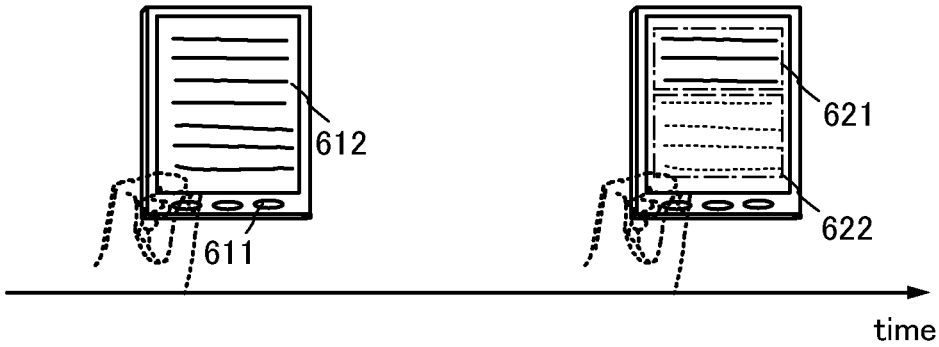

Contrary to the structure illustrated in the schematic view of FIG. 6B, in a structure of this embodiment, display is changed through display including both a region 621 in which display is changed and a region 622 in which display is not changed as illustrated in FIG. 6C, because a writing period of an image signal can be long enough to rewrite an image displayed on a display panel. With a structure in this embodiment, display is performed in the writing operation with the use of a first clock signal from a reference clock generation circuit, and display is changed with the use of the second clock signal from the dividing circuit in a writing operation for renewing an image such as switching pages. As a result, data is gradually written when pages are turned over, so that a viewer can see a state where pages are turned over.

As described above, an embodiment of the present invention can provide a display device in which deterioration in display quality due to a change in voltage applied to a display element is reduced and a lower visible efficiency in changing display is prevented.

This embodiment can be implemented in appropriate combination with the structures described in the other embodiments.

(Embodiment 2)

In this embodiment, an example of a transistor which can be applied to a display device disclosed in this specification will be described.

FIGS. 7A to 7D each illustrate an example of a cross-sectional structure of a transistor.

Figure 7A:
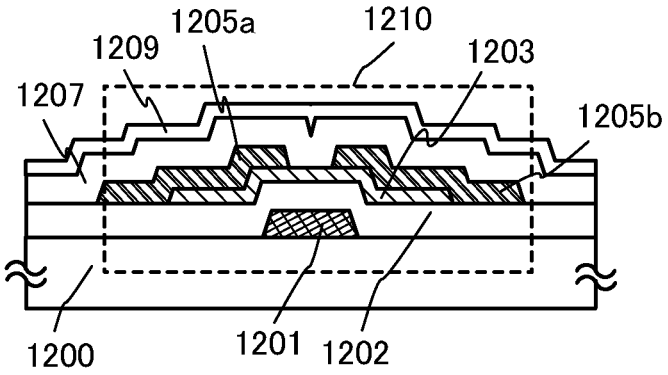
FIGS. 7A to 7D are cross sectional views for illustrating a display device which is an embodiment of the present invention.

A transistor 1210 illustrated in FIG. 7A is a kind of bottom-gate structure transistor and is also called an inverted staggered transistor.

The transistor 1210 includes, over a substrate 1200 having an insulating surface, a gate electrode layer 1201, a gate insulating layer 1202, a semiconductor layer 1203, a source electrode layer 1205*a*, and a drain electrode layer 1205*b*. An insulating layer 1207 is provided to cover the transistor 1210 and be stacked over the semiconductor layer 1203. A protective insulating layer 1209 is provided over the insulating layer 1207.

Figure 7B:
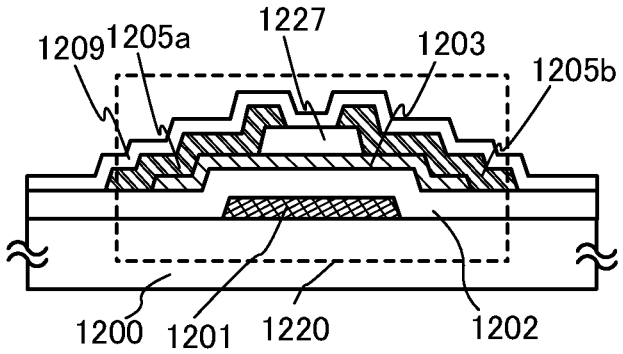

A transistor 1220 illustrated in FIG. 7B has a kind of bottom-gate structure called a channel-protective type (channel-stop type) and is also referred to as an inverted staggered transistor.

The transistor 1220 includes, over the substrate 1200 having an insulating surface, the gate electrode layer 1201, the gate insulating layer 1202, the semiconductor layer 1203, an insulating layer 1227 that is provided over a channel formation region in the semiconductor layer 1203 and functions as a channel protective layer, the source electrode layer 1205*a*, and the drain electrode layer 1205*b*. A protective insulating layer 1209 is provided to cover the transistor 1220.

Figure 7C:
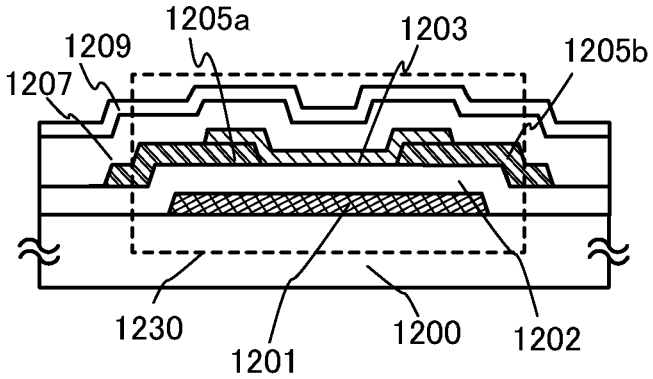

A transistor 1230 illustrated in FIG. 7C is a bottom-gate type transistor and includes, over a substrate 1200 which is a substrate having an insulating surface, a gate electrode layer 1201, a gate insulating layer 1202, a source electrode layer 1205*a*, a drain electrode layer 1205*b*, and a semiconductor layer 1203. An insulating layer 1207 is provided to cover the transistor 1230 and be in contact with the semiconductor layer 1203. A protective insulating layer 1209 is provided over the insulating layer 1207.

In the transistor 1230, the gate insulating layer 1202 is provided in contact with the substrate 1200 and the gate electrode layer 1201. The source electrode layer 1205*a* and the drain electrode layer 1205*b* are provided in contact with the gate insulating layer 1202. The semiconductor layer 1203 is provided over the gate insulating layer 1202, the source electrode layer 1205*a*, and the drain electrode layer 1205*b*.

Figure 7D:
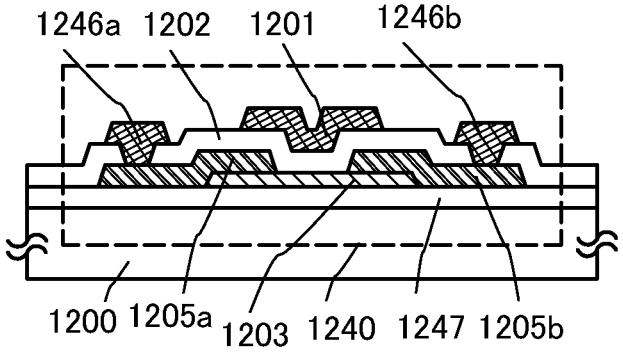

A transistor 1240 illustrated in FIG. 7D is a kind of top-gate structure transistor. The transistor 1240 includes, over a substrate 1200 having an insulating surface, an insulating layer 1247, a semiconductor layer 1203, a source electrode layer 1205*a* and a drain electrode layer 1205*b*, a gate insulating layer 1202, and a gate electrode layer 1201. A wiring layer 1246*a* and a wiring layer 1246*b* are provided in contact with the source electrode layer 1205*a* and the drain electrode layer 1205*b*, respectively, to be electrically connected to the source electrode layer 1205*a* and the drain electrode layer 1205*b*, respectively.

In this embodiment, an oxide semiconductor is used for the semiconductor layer 1203.

As an oxide semiconductor, an In—Sn—Ga—Zn—O-based metal oxide which is a four-component metal oxide; an In—Ga—Zn—O-based metal oxide, an In—Sn—Zn—O-based metal oxide, an In—Al—Zn—O-based metal oxide, a Sn—Ga—Zn—O-based metal oxide, an Al—Ga—Zn—O-based metal oxide, or a Sn—Al—Zn—O-based metal oxide which is a three-component metal oxide; an In—Zn—O-based metal oxide, a Sn—Zn—O-based metal oxide, an Al—Zn—O-based metal oxide, a Zn—Mg—O-based metal oxide, a Sn—Mg—O-based metal oxide, or an In—Mg—O-based metal oxide which is a two-component metal oxide; an In—O-based metal oxide, a Sn—O-based metal oxide, a Zn—O-based metal oxide, or the like can be used. Further, $SiO_2$ may be included in a semiconductor of the above metal oxide. Here, for example, an In—Ga—Zn—O-based metal oxide is an oxide including at least In, Ga, and Zn, and there is no particular limitation on the composition ratio thereof. Further, the In—Ga—Zn—O-based metal oxide may include an element other than In, Ga, and Zn.

As the oxide semiconductor, a thin film represented by the chemical formula, $InMO_3(ZnO)_m$ (m>0) can be used. Here, M represents one or more metal elements selected from Ga, Al, Mn, and Co. For example, M can be Ga, Ga and Al, Ga and Mn, Ga and Co, or the like.

Note that in the structure in this embodiment, the oxide semiconductor is an intrinsic (i-type) or substantially intrinsic semiconductor obtained by removal of hydrogen, which is an n-type impurity, from the oxide semiconductor for high purification so that the oxide semiconductor contains an impurity other than the main component as little as possible. In other words, the oxide semiconductor in this embodiment is a highly purified intrinsic (i-type) semiconductor or close to an intrinsic semiconductor obtained by removing impurities such as hydrogen and water as much as possible, not by adding an impurity element. In addition, the band gap of the oxide semiconductor is 2.0 eV or more, preferably 2.5 eV or more, still preferably 3.0 eV or more. Thus, in the oxide semiconductor, the generation of carriers due to thermal excitation can be suppressed. Therefore, the amount of increase in off-state current of the transistor having the channel formation region formed using the oxide semiconductor with an increase in the operation temperature can be reduced.

The number of carriers in the highly purified oxide semiconductor is very small (close to zero), and the carrier concentration is less than $1\times10^{14}/cm^3$, preferably less than $1\times10^{12}/cm^3$, further preferably less than $1\times10^{11}/cm^3$.

The number of carriers in the oxide semiconductor is so small that the off-state current of the transistor can be reduced. Specifically, the off-state current of the transistor in which an oxide semiconductor is used for the semiconductor layer (per channel width of 1 μm) can be reduced to 10 aA/μm ($1\times10^{-17}$ A/μm) or lower, further reduced to 1 aA/μm ($1\times10^{-18}$ A/μm) or lower, and still further reduced to 10 zA/μm ($1\times10^{-20}$ A/μm). In other words, in circuit design, the oxide semiconductor can be regarded as an insulator when the transistor is off. Moreover, when the transistor is on, the current supply capability of the oxide semiconductor is expected to be higher than that of a semiconductor layer formed of amorphous silicon.

In each of the transistors 1210, 1220, 1230, and 1240 which an oxide semiconductor is used for a semiconductor layer 1203, the current in an off state (the off-state current) can be low. Thus, the retention time for an electric signal such as image data can be extended, and an interval between writings can be extended. As a result, the refresh rate can be reduced, so that power consumption can be further reduced.

Furthermore, the transistors 1210, 1220, 1230, and 1240 in each of which an oxide semiconductor is used for a semiconductor layer 1203 can have relatively high field-effect mobility as the ones formed using an amorphous semiconductor; thus, the transistors can operate at high speed. As a result, high functionality and high-speed response of a display device can be realized.

Although there is no particular limitation on a substrate that can be used as the substrate 1200 having an insulating surface, the substrate needs to have heat resistance at least high enough to withstand heat treatment to be performed later. A glass substrate made of barium borosilicate glass, aluminoborosilicate glass, or the like can be used.

In the case where the temperature of heat treatment to be performed later is high, a glass substrate whose strain point is greater than or equal to 730° C. is preferably used. For a glass substrate, a glass material such as aluminosilicate glass, aluminoborosilicate glass, or barium borosilicate glass is used, for example. Note that a glass substrate containing a larger amount of barium oxide (BaO) than boron oxide ($B_2O_3$) may be used.

Note that a substrate formed of an insulator, such as a ceramic substrate, a quartz substrate, or a sapphire substrate, may be used instead of the glass substrate. Alternatively, crystallized glass or the like may be used. A plastic substrate or the like can be used as appropriate.

In the bottom-gate structure transistors 1210, 1220, and 1230, an insulating film serving as a base film may be provided between the substrate and the gate electrode layer. The base film has a function of preventing diffusion of an impurity element from the substrate, and can be formed with a single-layer structure or a layered structure including a silicon nitride film, a silicon oxide film, a silicon nitride oxide film, and/or a silicon oxynitride film.

The gate electrode layer 1201 can be formed with a single-layer structure or a layered structure using a metal material such as molybdenum, titanium, chromium, tantalum, tungsten, aluminum, copper, neodymium, or scandium or an alloy material containing any of these materials as its main component.

As a two-layer structure of the gate electrode layer 1201, any of the following layered structures is preferably employed, for example: a two-layer structure in which a molybdenum layer is stacked over an aluminum layer, a two-layer structure in which a molybdenum layer is stacked over a copper layer, a two-layer structure in which a titanium nitride layer or a tantalum nitride layer is stacked over a copper layer, or a two-layer structure in which a titanium nitride layer and a molybdenum layer are stacked. As a three-layer structure of the gate electrode layer 1201, it is preferable to employ a stack of a tungsten layer or a tungsten nitride layer, a layer of an alloy of aluminum and silicon or an alloy of aluminum and titanium, and a titanium nitride layer or a titanium layer. Note that the gate electrode layer can be formed using a light-transmitting conductive film. An example of a material for the light-transmitting conductive film is a light-transmitting conductive oxide.

The gate insulating layer 1202 can be formed with a single-layer structure or a layered structure using any of a silicon oxide layer, a silicon nitride layer, a silicon oxynitride layer, a silicon nitride oxide layer, an aluminum oxide layer, an aluminum nitride layer, an aluminum oxynitride layer, an aluminum nitride oxide layer, and a hafnium oxide layer by a plasma CVD method, sputtering, or the like.

The gate insulating layer 1202 can have a structure in which a silicon nitride layer and a silicon oxide layer are stacked from the gate electrode layer side. For example, a 100-nm-thick gate insulating layer is formed in such a manner that a silicon nitride layer ($SiN_y$ (y>0)) having a thickness of 50 nm to 200 nm is formed as a first gate insulating layer by sputtering and then a silicon oxide layer ($SiO_x$ (x>0)) having a thickness of 5 nm to 300 nm is stacked as a second gate insulating layer over the first gate insulating layer. The thickness of the gate insulating layer 1202 may be set as appropriate depending on characteristics needed for a transistor, and may be approximately 350 nm to 400 nm For a conductive film used for the source electrode layer 1205*a* and the drain electrode layer 1205*b*, an element selected from Al, Cr, Cu, Ta, Ti, Mo, and W, an alloy containing any of these elements, or an alloy film containing a combination of any of these elements can be used, for example. A structure may be employed in which a high-melting-point metal layer of Cr, Ta, Ti, Mo, W, or the like is stacked on one or both of a top surface and a bottom surface of a metal layer of Al, Cu, or the like. By using an aluminum material to which an element preventing generation of hillocks and whiskers in an aluminum film, such as Si, Ti, Ta, W, Mo, Cr, Nd, Sc, or Y, is added, heat resistance can be increased.

The source electrode layer 1205*a* and the drain electrode layer 1205*b* may have a single-layer structure or a layered structure of two or more layers. For example, the source electrode layer 1205*a* and the drain electrode layer 1205*b* can have a single-layer structure of an aluminum film containing silicon, a two-layer structure in which a titanium film is stacked over an aluminum film, or a three-layer structure in which a titanium film, an aluminum film, and a titanium film are stacked in this order.

A conductive film serving as the wiring layers 1246*a* and 1246*b* connected to the source electrode layer 1205*a* and the drain electrode layer 1205*b* can be formed using a material similar to that of the source and drain electrode layers 1205*a* and 1205*b*.

The conductive film to be the source electrode layer 1205*a* and the drain electrode layer 1205*b* (including a wiring layer formed using the same layer as the source and drain electrode layers) may be formed using a conductive metal oxide. As the conductive metal oxide, indium oxide ($In_2O_3$), tin oxide ($Sn0_2$), zinc oxide (ZnO), an alloy of indium tin oxide, an alloy of indium oxide and zinc oxide ($In_2O_3$-Zn0), or any of the metal oxide materials containing silicon or silicon oxide can be used.

As the insulating layers 1207, 1227, and 1247 and the protective insulating layer 1209, an inorganic insulating film such as an oxide insulating layer or a nitride insulating layer is preferably used.

As the insulating layers 1207, 1227, and 1247, an inorganic insulating film such as a silicon oxide film, a silicon oxynitride film, an aluminum oxide film, or an aluminum oxynitride film can be typically used.

As the protective insulating layer 1209, an inorganic insulating film such as a silicon nitride film, an aluminum nitride film, a silicon nitride oxide film, or an aluminum nitride oxide film can be used.

A planarization insulating film may be formed over the protective insulating layer 1209 in order to reduce surface roughness due to the transistor. The planarization insulating film can be formed using a heat-resistant organic material such as polyimide, acrylic, benzocyclobutene, polyamide, or epoxy. Other than such organic materials, it is possible to use a low-dielectric constant material (a low-k material), a siloxane-based resin, PSG (phosphosilicate glass), BPSG (borophosphosilicate glass), or the like. Note that the planarization insulating film may be formed by stacking a plurality of insulating films formed from these materials.

It is possible to provide display device in which the transistor is used in which an oxide semiconductor is used for a semiconductor layer in this embodiment.

This embodiment can be implemented in appropriate combination with the structures described in the other embodiments.

(Embodiment 3)

In this embodiment, an appearance and a cross section of a liquid crystal display device is illustrated and a structure thereof will be described. Specifically, when transistors are manufactured and used for a pixel portion and a driver circuit, a liquid crystal display device having a display function can be manufactured. Further, part of or the entire driver circuit can be formed over a substrate where a pixel portion is formed, using a transistor; thus, a system-on-panel can be obtained.

Note that the liquid crystal display device includes any of the following modules in its category: a module provided with a connector, for example, a flexible printed circuit (FPC), a tape automated bonding (TAB) tape, or a tape carrier package (TCP); a module provided with a printed wiring board at the end of a TAB tape or a TCP; and a module where an integrated circuit (IC) is directly mounted on a display element by a chip-on-glass (COG) method.

Figure 8A:
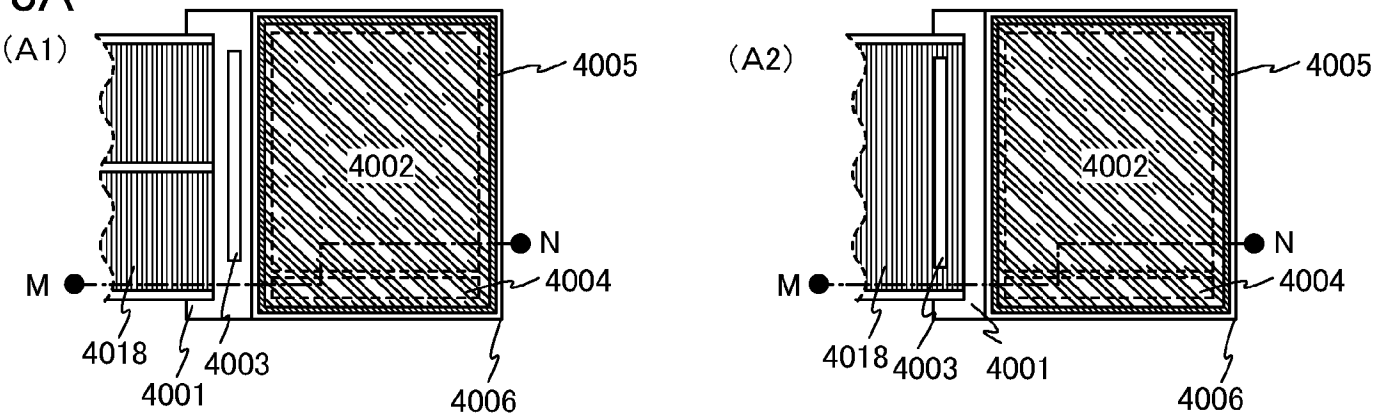
Figure 8B:
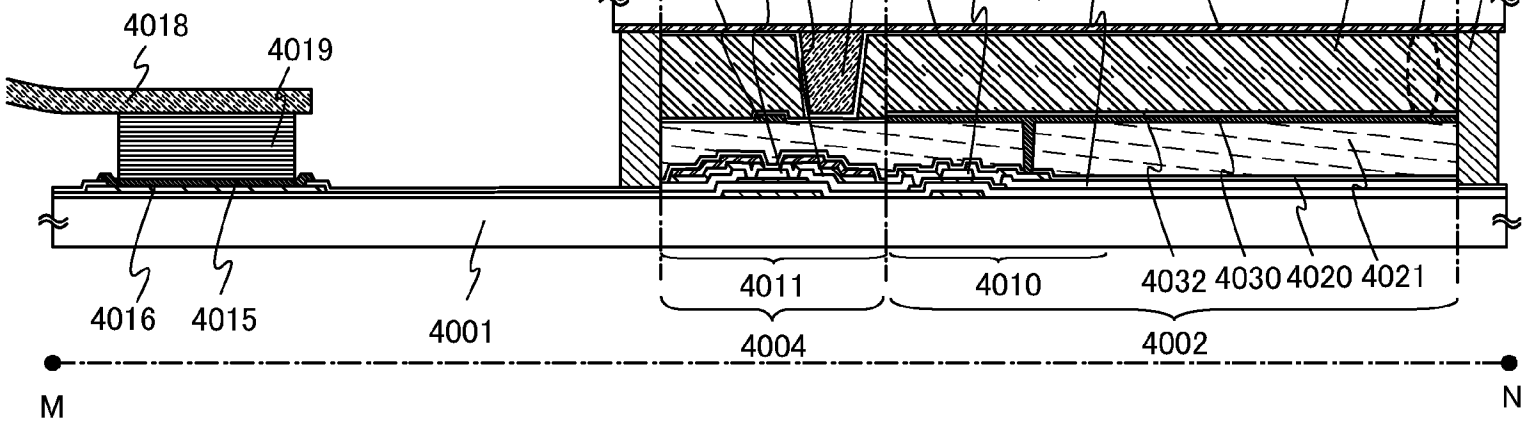

The appearance and a cross section of a liquid crystal display device will be described with reference to FIGS. 8A1, 8A2, and 8B. FIGS. 8A1 and 8A2 are plan views of panels in which transistors 4010 and 4011 and a liquid crystal element 4013 are sealed between a first substrate 4001 and a second substrate 4006 with a sealant 4005. FIG. 8B is a cross-sectional view along M-N in FIGS. 8A1 and 8A2.

The sealant 4005 is provided so as to surround a pixel portion 4002 and a scan line driver circuit 4004 that are provided over the first substrate 4001. The second substrate 4006 is provided over the pixel portion 4002 and the scan line driver circuit 4004. Therefore, the pixel portion 4002 and the scan line driver circuit 4004 are sealed together with a liquid crystal layer 4008, by the first substrate 4001, the sealant 4005, and the second substrate 4006. A signal line driver circuit 4003 that is formed using a single crystal semiconductor film or a polycrystalline semiconductor film over a substrate separately prepared is mounted in a region that is different from the region surrounded by the sealant 4005 over the first substrate 4001.

Note that there is no particular limitation on the connection method of a driver circuit that is separately formed, and a COG method, a wire bonding method, a TAB method, or the like can be used. FIG. 8A1 illustrates an example where the signal line driver circuit 4003 is mounted by a COG method. FIG. 8A2 illustrates an example where the signal line driver circuit 4003 is mounted by a TAB method.

The pixel portion 4002 and the scan line driver circuit 4004 provided over the first substrate 4001 include a plurality of transistors. FIG. 8B illustrates the transistor 4010 included in the pixel portion 4002 and the transistor 4011 included in the scan line driver circuit 4004. Insulating layers 4041*a*, 4041*b*, 4042*a*, 4042*b*, 4020, and 4021 are provided over the transistors 4010 and 4011.

A transistor in which an oxide semiconductor is used for a semiconductor layer can be used as the transistors 4010 and 4011. In this embodiment, the transistors 4010 and 4011 are n-channel transistors.

A conductive layer 4040 is provided over part of the insulating layer 4021, which overlaps with a channel formation region including an oxide semiconductor in the transistor 4011 for the driver circuit. The conductive layer 4040 is provided at the position overlapping with the channel formation region including the oxide semiconductor, so that the amount of change in threshold voltage of the transistor 4011 before and after the BT (bias-temperature) test can be reduced. The potential of the conductive layer 4040 may be the same or different from that of a gate electrode layer of the transistor 4011. The conductive layer 4040 can also function as a second gate electrode layer. The potential of the conductive layer 4040 may be GND or 0 V, or the conductive layer 4040 may be in a floating state.

A pixel electrode layer 4030 included in the liquid crystal element 4013 is electrically connected to the transistor 4010. A counter electrode layer 4031 of the liquid crystal element 4013 is provided for the second substrate 4006. A portion where the pixel electrode layer 4030, the counter electrode layer 4031, and the liquid crystal layer 4008 overlap with one another corresponds to the liquid crystal element 4013. Note that the pixel electrode layer 4030 and the counter electrode layer 4031 are provided with an insulating layer 4032 and an insulating layer 4033 functioning as alignment films, respectively, and the liquid crystal layer 4008 is sandwiched between the pixel electrode layer 4030 and the counter electrode layer 4031 with the insulating layers 4032 and 4033 provided therebetween.

Note that a light-transmitting substrate can be used as the first substrate 4001 and the second substrate 4006; glass, ceramics, or plastics can be used. As plastics, a fiberglass-reinforced plastics (FRP) plate, a polyvinyl fluoride (PVF) film, a polyester film, or an acrylic resin film can be used.

A spacer 4035 is a columnar spacer obtained by selective etching of an insulating film and is provided in order to control the distance (a cell gap) between the pixel electrode layer 4030 and the counter electrode layer 4031. Note that a spherical spacer may be used. The counter electrode layer 4031 is electrically connected to a common potential line formed over the substrate where the transistor 4010 is formed. With use of the common connection portion, the counter electrode layer 4031 and the common potential line can be electrically connected to each other by conductive particles arranged between a pair of substrates. Note that the conductive particles can be included in the sealant 4005.

Alternatively, liquid crystal exhibiting a blue phase for which an alignment film is unnecessary may be used. A blue phase is one of liquid crystal phases, which is generated just before a cholesteric phase changes into an isotropic phase while temperature of cholesteric liquid crystal is increased. Since the blue phase is only generated within a narrow range of temperature, a liquid crystal composition containing a chiral agent at 5 wt % or more so as to improve the temperature range is used for the liquid crystal layer 4008. The liquid crystal composition that includes a liquid crystal exhibiting a blue phase and a chiral agent has a short response time of 1 msec or less, has optical isotropy, which makes the alignment process unneeded, and has a small viewing angle dependence.

Note that this embodiment can also be applied to a semi-transmissive liquid crystal display device in addition to a transmissive liquid crystal display device.

This embodiment shows the example of the liquid crystal display device in which a polarizing plate is provided on the outer side of the substrate (on the viewer side) and a coloring layer and an electrode layer used for a display element are provided in this order on the inner side of the substrate; alternatively, a polarizing plate may be provided on the inner side of the substrate. The layered structure of the polarizing plate and the coloring layer is not limited to that in this embodiment and may be set as appropriate depending on materials of the polarizing plate and the coloring layer or conditions of the manufacturing process. Further, a light-blocking film serving as a black matrix may be provided in a portion other than a display portion.

The insulating layer 4041*a* that serves as a channel protective layer and the insulating layer 4041*b* that covers an outer edge portion (including a side surface) of the stack of the semiconductor layers including an oxide semiconductor are formed in the transistor 4011. In a similar manner, the insulating layer 4042*a* that serves as a channel protective layer and the insulating layer 4042*b* that covers an outer edge portion (including a side surface) of the stack of the semiconductor layers including an oxide semiconductor are formed in the transistor 4010.

The insulating layers 4041*b* and 4042*b* that are oxide insulating layers covering the outer edge portion (including the side surface) of the stack of the oxide semiconductor layers can increase the distance between the gate electrode layer and a wiring layer (e.g., a source wiring layer or a capacitor wiring layer) formed over or around the gate electrode layer, so that the parasitic capacitance can be reduced. In order to reduce the surface roughness of the transistors, the transistors are covered with the insulating layer 4021 serving as a planarizing insulating film. Here, as the insulating layers 4041*a*, 4041*b*, 4042*a*, and 4042*b*, a silicon oxide film is formed by sputtering, for example.

Moreover, the insulating layer 4020 is formed over the insulating layers 4041*a*, 4041*b*, 4042*a*, and 4042*b*. As the insulating layer 4020, a silicon nitride film is formed by RF sputtering, for example.

The insulating layer 4021 is formed as the planarizing insulating film. As the insulating layer 4021, an organic material having heat resistance, such as polyimide, acrylic, benzocyclobutene, polyamide, or epoxy can be used. Other than such organic materials, it is also possible to use a low-dielectric constant material (a low-k material), a siloxane-based resin, PSG (phosphosilicate glass), BPSG (borophosphosilicate glass), or the like. Note that the insulating layer 4021 may be formed by stacking a plurality of insulating films formed of these materials.

Note that a siloxane-based resin corresponds to a resin including a Si—O—Si bond formed using a siloxane-based material as a starting material. The siloxane-based resin may include an organic group (e.g., an alkyl group or an aryl group) or a fluoro group as a substituent. The organic group may include a fluoro group.

In this embodiment, a plurality of transistors in the pixel portion may be surrounded together by a nitride insulating film. It is possible to use a nitride insulating film as the insulating layer 4020 and the gate insulating layer and to provide a region where the insulating layer 4020 is in contact with the gate insulating layer as illustrated in FIG. 8B so as to surround at least the periphery of the pixel portion in the active matrix substrate. In this manufacturing process, entry of moisture from the outside can be prevented. Further, even after the device is completed as a liquid crystal display device, entry of moisture from the outside can be prevented in the long term, and the long-term reliability of the device can be improved.

There is no particular limitation on the formation method of the insulating layer 4021, and any of the following methods and tools can be employed, for example, depending on the material: methods such as sputtering, an SOG method, a spin coating method, a dipping method, a spray coating method, a droplet discharge method (e.g., an ink-jet method, screen printing, and offset printing); and tools (equipment) such as a doctor knife, a roll coater, a curtain coater, and a knife coater. The baking step of the insulating layer 4021 also serves as annealing of the semiconductor layer, so that a liquid crystal display device can be efficiently manufactured.

The pixel electrode layer 4030 and the counter electrode layer 4031 can be formed using a light-transmitting conductive material such as indium oxide containing tungsten oxide, indium zinc oxide containing tungsten oxide, indium oxide containing titanium oxide, indium tin oxide containing titanium oxide, indium tin oxide, indium zinc oxide, or indium tin oxide to which silicon oxide is added.

Alternatively, the pixel electrode layer 4030 and the counter electrode layer 4031 can be formed using a conductive composition including a conductive high molecule (also referred to as a conductive polymer). The pixel electrode formed using the conductive composition preferably has a sheet resistance of less than or equal to 10000 ohms per square and a transmittance of greater than or equal to 70% at a wavelength of 550 nm. Further, the resistivity of the conductive high molecule included in the conductive composition is preferably less than or equal to 0.1Ω·cm.

As the conductive high molecule, a so-called π-electron conjugated conductive high molecule can be used. For example, polyaniline or a derivative thereof, polypyrrole or a derivative thereof, polythiophene or a derivative thereof, and a copolymer of two or more of aniline, pyrrole, and thiophene or a derivative thereof can be given.

A variety of signals and potentials are supplied from an FPC 4018 to the signal line driver circuit 4003 which is formed separately, the scan line driver circuit 4004, or the pixel portion 4002.

A connection terminal electrode 4015 is formed from the same conductive film as the pixel electrode layer 4030 included in the liquid crystal element 4013, and a terminal electrode 4016 is formed from the same conductive film as source and drain electrode layers of the transistors 4010 and 4011.

The connection terminal electrode 4015 is electrically connected to a terminal included in the FPC 4018 via an anisotropic conductive film 4019.

Note that FIGS. 8A1 and 8A2 illustrate the example in which the signal line driver circuit 4003 is formed separately and mounted on the first substrate 4001; however, the this embodiment is not limited to this structure. The scan line driver circuit may be separately formed and then mounted, or only part of the signal line driver circuit or part of the scan line driver circuit may be separately formed and then mounted.

Figure 9:
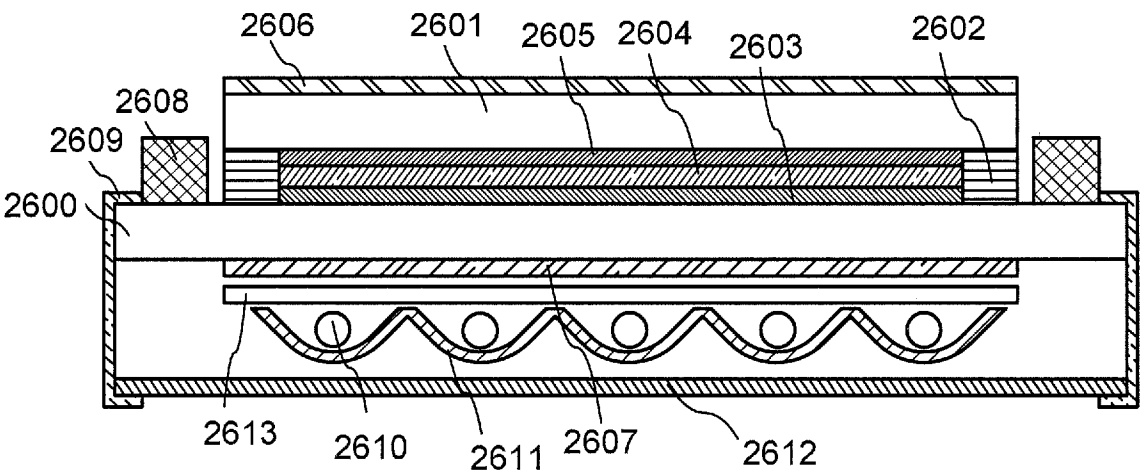
FIG. 9 is a cross sectional view for illustrating a display device which is an embodiment of the present invention.

FIG. 9 illustrates an example of a structure of a liquid crystal display device.

FIG. 9 illustrates an example of a liquid crystal display device. A TFT substrate 2600 and a counter substrate 2601 are fixed to each other with a sealant 2602. A pixel portion 2603 including a TFT and the like, a display element 2604 including a liquid crystal layer, and a coloring layer 2605 are provided between the substrates so that a display region is formed. The coloring layer 2605 is necessary to perform color display. In the RGB system, coloring layers corresponding to colors of red, green, and blue are provided for pixels. A polarizing plate 2606 is provided on the outer side of the counter substrate 2601. A polarizing plate 2607 and a diffusion plate 2613 are provided on the outer side of the TFT substrate 2600. A light source includes a cold cathode tube 2610 and a reflective plate 2611. A circuit board 2612 is connected to a wiring circuit portion 2608 of the TFT substrate 2600 by a flexible wiring board 2609 and includes an external circuit such as a control circuit or a power source circuit. The polarizing plate and the liquid crystal layer may be stacked with a retardation plate therebetween.

For a method for driving the liquid crystal display device, a TN (twisted nematic) mode, an IPS (in-plane-switching) mode, an FFS (fringe field switching) mode, an MVA (multi-domain vertical alignment) mode, a PVA (patterned vertical alignment) mode, an ASM (axially symmetric aligned micro-cell) mode, an OCB (optically compensated birefringence) mode, an FLC (ferroelectric liquid crystal) mode, an AFLC (antiferroelectric liquid crystal) mode, or the like can be used.

Through the above-described process, it is possible to manufacture a liquid crystal display device.

This embodiment can be implemented in appropriate combination with the structures described in the other embodiments.

(Embodiment 4)

In this embodiment, a structure of the liquid crystal display device described in the above embodiments which has a touch-panel function will be described with reference to FIGS. 10A and 10B.

Figure 10A:
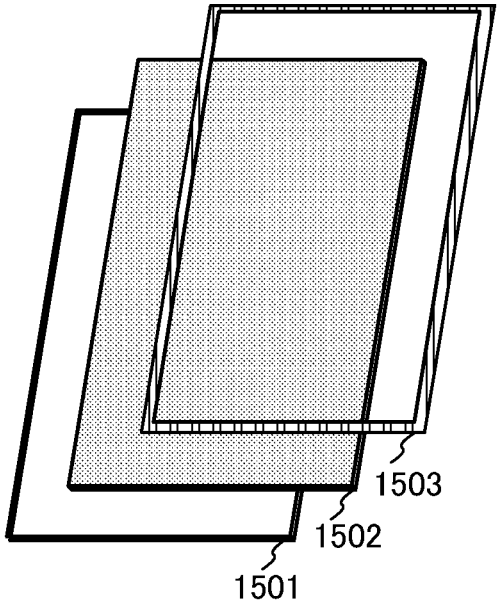
FIGS. 10A and 10B are perspective views for illustrating a display device which is an embodiment of the present invention.

FIG. 10A is a schematic view of a liquid crystal display device of this embodiment. FIG. 10A illustrates a structure in which a touch panel unit 1502 is stacked on a liquid crystal display panel 1501 which is the liquid crystal display device of the above embodiment and they are attached with a housing (case) 1503. As the touch panel unit 1502, a resistive touch sensor, a surface capacitive touch sensor, a projected capacitive touch sensor, or the like can be used as appropriate.

The liquid crystal display panel 1501 and the touch panel unit 1502 are manufactured separately and stacked as illustrated in FIG. 10A, whereby the cost of manufacturing a liquid crystal display device having a touch-panel function can be reduced.

Figure 10B:
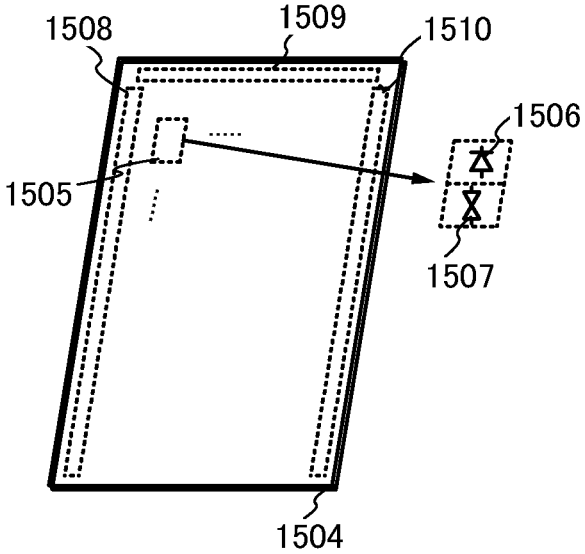

FIG. 10B illustrates a structure of a liquid crystal display device having a touch-panel function, which is different from that illustrated in FIG. 10A. A liquid crystal display device 1504 illustrated in FIG. 10B includes a plurality of pixels 1505 each having a light sensor 1506 and a liquid crystal element 1507. Therefore, the touch panel unit 1502 is not necessarily stacked, which is different from that illustrated in FIG. 10A. Thus, a liquid crystal display device can be thinned. Further, a gate line driver circuit 1508, a signal line driver circuit 1509, and a light sensor driver circuit 1510 are manufactured over the same substrate as the pixels 1505. Thus, a liquid crystal display device can be reduced in size. Note that the light sensor 1506 may be formed using amorphous silicon or the like and stacked on a transistor including an oxide semiconductor.

Note that this embodiment can be combined with other embodiments as appropriate.

(Embodiment 5)

In this embodiment, an example of an electronic device including the liquid crystal display device described in any of the above-described embodiments will be described.

Figure 11A:
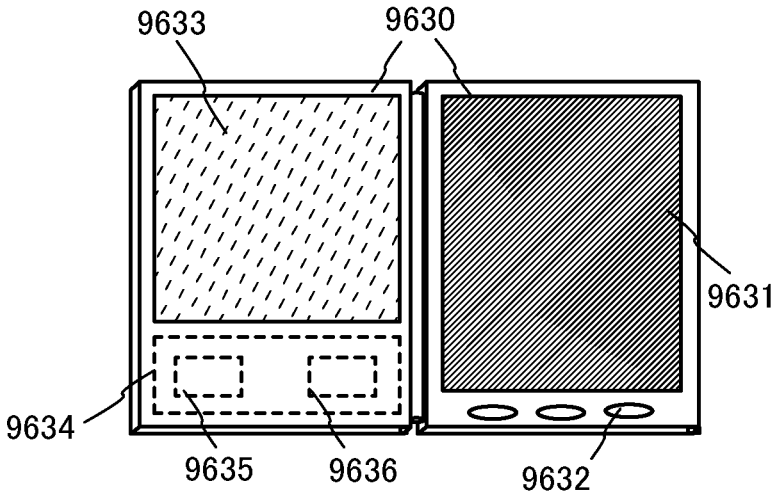
FIGS. 11A and 11B are diagrams for illustrating an e-book reader which is an embodiment of the present invention.

FIG. 11A illustrates an e-book reader (also referred to as an e-Book) that can include a housing 9630, a display portion 9631, operation keys 9632, a solar cell 9633, a charge and discharge control circuit 9634, and the like. The e-book reader in FIG. 11A can have a function of displaying a variety of information (e.g., a still image, a moving image, and a text image) on the display portion; a function of displaying a calendar, a date, the time, and the like on the display portion; a function of operating or editing the information displayed on the display portion; a function of controlling processing by various kinds of software (programs); and the like. Note that FIG. 11A illustrates a structure in which a battery 9635 and a DC-DC convertor (hereinafter, abbreviated as a convertor 9636) are provided as an example of the charge and discharge control circuit 9634.

With the structure illustrated in FIG. 11A, when a semi-transmissive liquid crystal display device is used as the display portion 9631, the e-book reader is expected to be used in a comparatively bright environment, in which case the structure in FIG. 11A is preferable because the solar cell 9633 can efficiently generate power and the battery 9635 can efficiently charge power. Note that a structure in which the solar cell 9633 is provided on each of a front surface and a rear surface of the housing 9630 is preferable in order to charge the battery 9635. Note that when a lithium ion battery is used as the battery 9635, an advantage such as reduction in size can be obtained.

In addition, a structure and operation of the charge and discharge control circuit 9634 illustrated in FIG. 11A is described with reference to a block diagram of FIG. 11B.

Figure 11B:
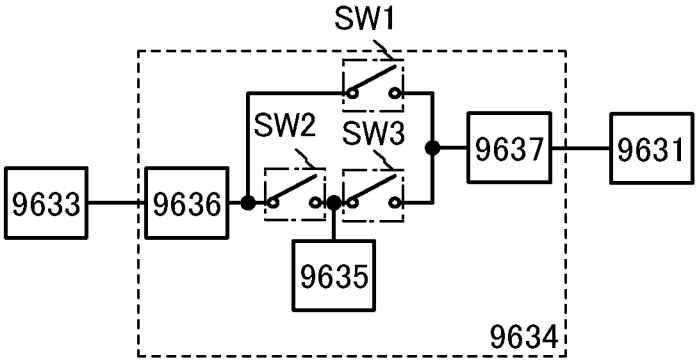

FIG. 11B shows the solar cell 9633, the battery 9635, the converter 9636, a converter 9637, switches SW1 to SW3, and the display portion 9631. The charge and discharge control circuit 9634 includes the battery 9635, the converter 9636, the converter 9637, and the switches SW1 to SW3.

First, an example of operation of when the solar cell 9633 generates power by using external light is described. The power generated by the solar cell is raised or lowered by the converter 9636 to be the voltage which is stored in the battery 9635. When the power from the solar cell 9633 is used for operation of the display portion 9631, the switch SW1 is turned on and the power is raised or lowered by the converter 9637 to be the voltage needed for the display portion 9631. When display is not performed on the display portion 9631, the switch SW1 may be turned off and the switch SW2 may be turned on, whereby the battery 9635 is charged.

Next, an example of operation of when the solar cell 9633 does not generate power by using external light is described. The power stored in the battery 9635 is raised or lowered by the converter 9637 when the switch SW3 is turned on. Then, the power from the battery 9635 is used for operation of the display portion 9631.

Note that the solar cell 9633 is described as an example of a charging unit here; however, charging the battery 9635 may be performed by another unit. Alternatively, a combination of another charging unit may be used.

This embodiment can be implemented in appropriate combination with the structures described in the other embodiments.

This application is based on Japanese Patent Application serial no. 2010-041987 filed with Japan Patent Office on Feb. 26, 2010, the entire contents of which are hereby incorporated by reference.

Explanation of Reference

101: first still image display period, 102: second still image display period, 103: period, 104: period, 105: period, 106: period, 301: period, 400: liquid crystal display device, 401: display panel, 402: display controller, 403: memory circuit, 404: CPU, 405: external input device, 406: display portion, 407: driver circuit portion, 408: gate line, 409: source line, 410: pixel, 411: transistor, 412: liquid crystal element, 413: capacitor, 414: gate line driver circuit, 415: source line driver circuit, 416: reference clock generation circuit, 417: dividing circuit, 418: switching circuit, 419: display mode control circuit, 420: control signal generation circuit, 421: image signal output circuit, 501: step, 502: step, 503: step, 504: step, 505: step, 601: paper book, 602: letter, 611: operation button, 612: display panel, 621: region, 622: region, 1200: substrate, 1201: gate electrode layer, 1202: gate insulating layer, 1203: semiconductor layer, 1205a: source electrode layer, 1205b: drain electrode layer, 1246a: wiring layer, 1246b: wiring layer, 1207: insulating layer, 1209: protective insulating layer, 1210: transistor, 1220: transistor, 1227: insulating layer, 1230: transistor, 1240: transistor, 1247: insulating layer, 1501: liquid crystal display panel, 1502: touch panel unit, 1503: housing, 1504: liquid crystal display device, 1505: pixel, 1506: light sensor, 1507: liquid crystal element, 1508: gate line driver circuit, 1509: signal line driver circuit, 1510: light sensor driver circuit, 2600: TFT substrate, 2601: counter substrate, 2602: sealant, 2603: pixel portion, 2604: display element, 2605: coloring layer, 2606: polarizing plate, 2607: polarizing plate, 2608: wiring circuit portion, 2609: flexible wiring board, 2610: cold cathode tube, 2611: reflective plate, 2612: circuit board, 2613: diffusion plate, 4001: substrate, 4002: pixel portion, 4003: signal line driver circuit, 4004: scan line driver circuit, 4005: sealant, 4006: substrate, 4008: liquid crystal layer, 4010: transistor, 4011: transistor, 4013: liquid crystal element, 4015: connection terminal electrode, 4016: terminal electrode, 4018: FPC, 4019: anisotropic conductive film, 4020: insulating layer, 4021: insulating layer, 4030: pixel electrode layer, 4031: counter electrode layer, 4032: insulating layer, 4033: insulating layer, 4040: conductive layer, 4041a: insulating layer, 4041b: insulating layer, 4042a: insulating layer, 4042b: insulating layer, 9630: housing, 9631: display portion, 9632: operation key, 9633: solar cell, 9634: charge and discharge control circuit, 9635: battery, 9636: convertor, 9637: convertor

The invention claimed is:

1. A display device comprising:

a display portion comprising pixels, each of the pixels comprising a transistor; and a display controller configured to control the display portion such that the display portion performs display by switching a first still image display period and a second still image display period, wherein the first still image display period comprises a first frame period and a second frame period, wherein the first frame period comprises a writing period in which a first image signal is written to first to n-th rows of the pixels and a holding period in which the first image signal is held, wherein the second frame period comprises a writing period in which a second image signal is written and a holding period in which the second image signal is held, wherein the second still image display period comprises a third frame period, wherein the third frame period comprises a writing period in which a third image signal is written to the first to n-th rows of the pixels and a holding period in which the third image signal is held, wherein the second frame period follows the first frame period, wherein the third frame period follows the second frame period, wherein the first image signal and the second image signal are the same, wherein the third image signal and the second image signal are different, and wherein the display controller is configured to control the display portion such that a length of the writing period of the third frame period is longer than a length of the writing period of each of the first frame period and the second frame period.

2. The display device according to claim 1, wherein the display controller comprises a switching circuit and a display mode control circuit, wherein the switching circuit is configured to switch a first clock signal and a second clock signal and output the first clock signal or the second clock signal, and wherein the display mode control circuit is configured to control the switching circuit.

3. The display device according to claim 1, wherein the display controller comprises a reference clock generation circuit, a dividing circuit, a switching circuit and a display mode control circuit, wherein the reference clock generation circuit is configured to output a first clock signal, wherein the dividing circuit is configured to divide the first clock signal and output a second clock signal, wherein the switching circuit is configured to switch the first clock signal and the second clock signal and output the first clock signal or the second clock signal, and wherein the display mode control circuit is configured to control the switching circuit.

4. The display device according to claim 1, wherein the writing period of the third frame period is 16.6 milliseconds or less and the writing period of each of the first frame period and the second frame period is 1 second or more.

5. The display device according to claim 1, wherein the transistor comprises an oxide semiconductor layer.

6. The display device according to claim 1, wherein a carrier concentration of the transistor is lower than $1\times10^{14}/cm^3$.

7. The display device according to claim 1, wherein an off-state current of the transistor is less than or equal to $1\times10^{-17}$ A/μm .

8. An e-book reader comprising the display device according to claim 1.

9. A method for driving a display device comprising the steps of:

displaying a first still image during a first still image display period; and switching from the first still image display period to a second still image display period, thereby displaying a second still image during the second still image display period, wherein the first still image display period comprises a first frame period and a second frame period, wherein the first frame period comprises a writing period in which a first image signal is written to first to n-th rows of pixels and a holding period in which the first image signal is held, wherein the second frame period comprises a writing period in which a second image signal is written and a holding period in which the second image signal is held, wherein the second still image display period comprises a third frame period, wherein the third frame period comprises a writing period in which a third image signal is written to first to n-th rows of the pixels and a holding period in which the third image signal is held, wherein the second frame period follows the first frame period, wherein the third frame period follows the second frame period, wherein the first image signal and the second image signal are the same, wherein the third image signal and the second image signal are different, and wherein a length of the writing period of the third frame period is longer than a length of the writing period of each of the first frame period and the second frame period.

10. The method for driving a display device according to claim 9, wherein the first still image display period and the second still image display period are switched by using a display controller, wherein the display controller is configured to control a display portion such that the display portion performs display by switching the first still image display period and the second still image display period, and wherein the display controller is configured to control the display portion such that the length of the writing period of the third frame period is longer than the length of the writing period of each of the first frame period and the second frame period.

11. The method for driving a display device according to claim 9, wherein the first still image display period and the second still image display period are switched by using a display controller, wherein the display controller is configured to control a display portion such that the display portion performs display by switching the first still image display period and the second still image display period, wherein the display controller is configured to control the display portion such that the length of the writing period of the third frame period is longer than the length of the writing period of each of the first frame period and the second frame period, wherein the display controller comprises a switching circuit and a display mode control circuit, wherein the switching circuit is configured to switch a first clock signal and a second clock signal and output the first clock signal or the second clock signal, and wherein the display mode control circuit is configured to control the switching circuit.

12. The method for driving a display device according to claim 9, wherein the first still image display period and the second still image display period are switched by using a display controller, wherein the display controller is configured to control a display portion such that the display portion performs display by switching the first still image display period and the second still image display period, wherein the display controller is configured to control the display portion such that the length of the writing period of the third frame period is longer than the length of the writing period of each of the first frame period and the second frame period, wherein the display controller comprises a reference clock generation circuit, a dividing circuit, a switching circuit and a display mode control circuit, wherein the reference clock generation circuit is configured to output a first clock signal, wherein the dividing circuit is configured to divide the first clock signal and output a second clock signal, wherein the switching circuit is configured to switch the first clock signal and the second clock signal and output the first clock signal or the second clock signal, and wherein the display mode control circuit is configured to control the switching circuit.

13. The method for driving a display device according to claim 9, wherein the writing period of the third frame period is 16.6 milliseconds or less and the writing period of each of the first frame period and the second frame period is 1 second or more.

14. A display device comprising:

a display portion comprising pixels, each of the pixels comprising a transistor; and a display controller configured to control the display portion such that a length of a first writing period is longer than a length of a second writing period, wherein in a case where the first writing period follows a third writing period, an image signal to be written to first to n-th rows of the pixels during the first writing period and an image signal written to the first to n-th rows of the pixels during the third writing period are different, and wherein in a case where the second writing period follows the third writing period, an image signal to be written to the first to n-th rows of the pixels during the second writing period and the image signal written to the first to n-th rows of the pixels during the third writing period are the same.

15. The display device according to claim 14, wherein the first writing period is 16.6 milliseconds or less and the second writing period is 1 second or more.

16. The display device according to claim 14, wherein the transistor comprises an oxide semiconductor layer.

17. The display device according to claim 14, wherein a carrier concentration of the transistor is lower than $1\times10^{14}$ /cm$^3$.

18. The display device according to claim 14, wherein an off-state current of the transistor is less than or equal to $1\times10^{-17}$ A/μm.

19. An e-book reader comprising the display device according to claim 14.

* * * * *